US006382418B1

(12) United States Patent
Weder

(10) Patent No.: US 6,382,418 B1
(45) Date of Patent: May 7, 2002

(54) FLORAL WRAPPER UTILIZING A BREATHABLE PACKAGING MATERIAL

(75) Inventor: Donald E. Weder, Highland, IL (US)

(73) Assignee: Southpac Trust International, Inc., Rarotonga Cook Island ( * ) Notice: Subject to any disclaimer, the term of this patent is extended or adjusted under 35 U.S.C. 154(b) by 0 days.

(21) Appl. No.: 09/605,684

(22) Filed: Jun. 26, 2000

Related U.S. Application Data

(63) Continuation-in-part of application No. 09/471,762, filed on Dec. 23, 1999, now abandoned.

(51) Int. Cl.[7] ..... B65D 85/50
(52) U.S. Cl. ..... 206/423; 47/72; 428/907
(58) Field of Search ..... 206/213.1, 204, 206/423; 47/72, 84; 53/397, 399, 400, 401, 402; 229/87.06, 87.08; 424/409, 411–415; 426/118, 124

(56) References Cited

U.S. PATENT DOCUMENTS

| | | | |
|---|---|---|---|
| 2,774,187 | A | 12/1956 | Smithers |
| 3,022,605 | A | 2/1962 | Reynolds |
| 3,044,885 | A | 7/1962 | Loehr |
| 3,493,464 | A | 2/1970 | Bowers et al. |
| 3,650,775 | A | 3/1972 | Simon et al. |
| 3,653,873 | A | 4/1972 | Bayer |
| 3,657,840 | A | 4/1972 | Benoist |
| 3,728,213 | A | 4/1973 | Hinz |
| 3,864,468 | A | 2/1975 | Hyman et al. |
| 3,959,556 | A | 5/1976 | Morrison |
| 3,998,944 | A | 12/1976 | Long |
| 4,008,351 | A | 2/1977 | Inoue et al. |
| 4,111,922 | A | 9/1978 | Beede et al. |
| 4,118,890 | A | 10/1978 | Shore |
| 4,189,868 | A | 2/1980 | Tymchuck et al. |
| 4,297,811 | A | 11/1981 | Weder |
| 4,343,853 | A | 8/1982 | Morrison |
| 4,400,910 | A | 8/1983 | Koudstaal et al. |
| 4,401,712 | A | 8/1983 | Morrison |
| 4,407,897 | A | 10/1983 | Farrell et al. |
| 4,413,725 | A | 11/1983 | Bruno et al. |
| 4,528,226 | A | 7/1985 | Sweeny |
| 4,533,435 | A | 8/1985 | Intili |
| 4,606,956 | A | 8/1986 | Charbonneau et al. |
| 4,646,388 | A | 3/1987 | Weder et al. |
| 4,661,388 | A | 4/1987 | Charbonneau |
| 4,663,077 | A | 5/1987 | Rei et al. |
| 4,666,706 | A | 5/1987 | Farquharson |
| 4,733,521 | A | 3/1988 | Weder et al. |
| 4,743,448 | A | 5/1988 | Bahadir et al. |
| 4,769,264 | A | 9/1988 | Dreger |
| 4,773,182 | A | 9/1988 | Weder et al. |
| 4,792,484 | A | 12/1988 | Moritani |
| 4,842,875 | A | 6/1989 | Anderson |
| 4,848,929 | A | 7/1989 | Rawl |
| 4,861,632 | A | 8/1989 | Caggiano |
| 4,879,078 | A | 11/1989 | Antoon, Jr. |
| 4,888,175 | A | 12/1989 | Burton, Jr. et al. |
| 4,910,032 | A | 3/1990 | Antoon, Jr. |
| 4,923,650 | A | 5/1990 | Antoon, Jr. et al. |
| 4,925,517 | A | 5/1990 | Charbonneau et al. |
| 4,988,557 | A | 1/1991 | Charbonneau |

(List continued on next page.)

*Primary Examiner*—Shian Luong
(74) *Attorney, Agent, or Firm*—Dunlap, Codding & Rogers, P.C.

(57) ABSTRACT

A breathable packaging material used for packaging items, such as floral groupings, flower pots, fresh produce, food, medical supplies/equipment and pharmaceutical products, thereby forming a breathable package for containing such items. The breathable packaging material comprises a sheet of material having controlled atmosphere characteristics and a coating composition on at least a portion thereof, the coating composition containing a desiccant and at least one atmosphere control agent so as to provide controlled atmosphere characteristics for items packaged therein. Methods for using breathable packaging materials are also disclosed.

104 Claims, 11 Drawing Sheets

U.S. PATENT DOCUMENTS

| | | | |
|---|---|---|---|
| 4,990,381 | A | 2/1991 | Holzner |
| 5,011,698 | A | 4/1991 | Antoon, Jr. et al. |
| 5,045,331 | A | 9/1991 | Antoon, Jr. |
| 5,105,599 | A | 4/1992 | Weder |
| 5,111,637 | A | 5/1992 | Weder et al. |
| 5,147,706 | A | 9/1992 | Kingman |
| 5,160,768 | A | 11/1992 | Antoon, Jr. |
| 5,181,364 | A | 1/1993 | Weder et al. |
| 5,209,869 | A | 5/1993 | Miksic et al. |
| 5,242,052 | A | 9/1993 | Weder |
| 5,254,401 | A | 10/1993 | Kelch et al. |
| 5,300,354 | A | 4/1994 | Harita et al. |
| 5,320,778 | A | 6/1994 | Miksic et al. |
| 5,561,863 | A | 10/1996 | Carlson, II |
| 5,666,784 | A | 9/1997 | Weder |

FLORAL WRAPPER UTILIZING A BREATHABLE PACKAGING MATERIAL

CROSS REFERENCE TO RELATED APPLICATIONS

This application is a continuation-in-part of copending application U.S. Ser. No. 09/471,762, filed Dec. 23, 1999, abandoned entitled "FLORAL WRAPPER UTILIZING A BREATHABLE PACKAGING MATERIAL".

STATEMENT REGARDING FEDERALLY SPONSORED RESEARCH OR DEVELOPMENT

Not Applicable.

BACKGROUND OF THE INVENTION

Field of the Invention

This invention relates to wrapping materials and more particularly, but not by way of limitation, to materials having controlled atmosphere properties which permit permeability of specific substances and/or gases, while inhibiting growth of microorganisms on objects wrapped with such materials.

DESCRIPTION OF THE PREFERRED EMBODIMENTS

Description of FIGS. 1–4

Several disadvantages exist in providing a wrapping or packaging for fresh flowers, fresh produce and/or food. Further, many of these same disadvantages also apply to providing a wrapping or packaging for medical supplies/equipment and pharmaceutical products.

In the case of a floral grouping, for example, it is desirable to have a wrapping which permits a flow of a selected atmosphere to the packaged floral grouping. Such wrapping/packaging further would desirably contain one or more atmosphere control agents. The term "atmosphere control agent" as used herein is understood to include desiccants to reduce excess moisture so that the likelihood of growth of unwanted microorganisms is reduced; antifungal and antimicrobial agents to reduce and/or eliminate unwanted microorganisms, such as, but not by way of limitation, fungi, bacteria, algae, and the like; and/or non-fogging agents so that the item packaged would remain clearly visible through such packaging.

The present invention contemplates a breathable packaging material comprising a sheet of material having a lacquer or coating composition on at least portions thereof which contains one or more atmosphere control agents so as to permit selective control of the atmosphere to which the contents are exposed. That is, at least portions of the coated sheet of material are permeable to some elements, substances and/or compositions (in either liquid or gaseous form), but impermeable to others, and the atmosphere control agents prevent or retard the growth of microorganisms while providing optimal visual display of the item packaged therein. In this manner such items as floral groupings, fresh produce, food, pharmaceutical products, and/or medical supplies/equipment may be packaged such that the item contained therein is maintained in the most commercially viable manner, and for an ideal or more controlled length of time.

Figure 1:
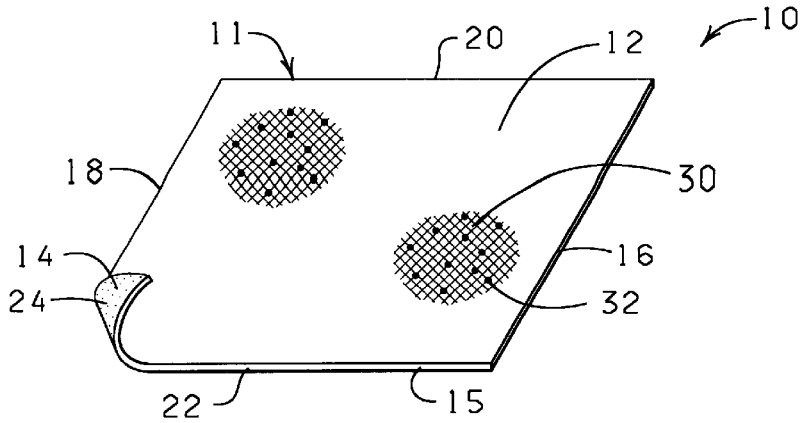
FIG. 1 is a perspective view of a sheet of breathable packaging material constructed in accordance with the present invention, a corner of the sheet of breathable packaging material turned back for illustration purposes only to show a lower surface thereof.
Figure 2:
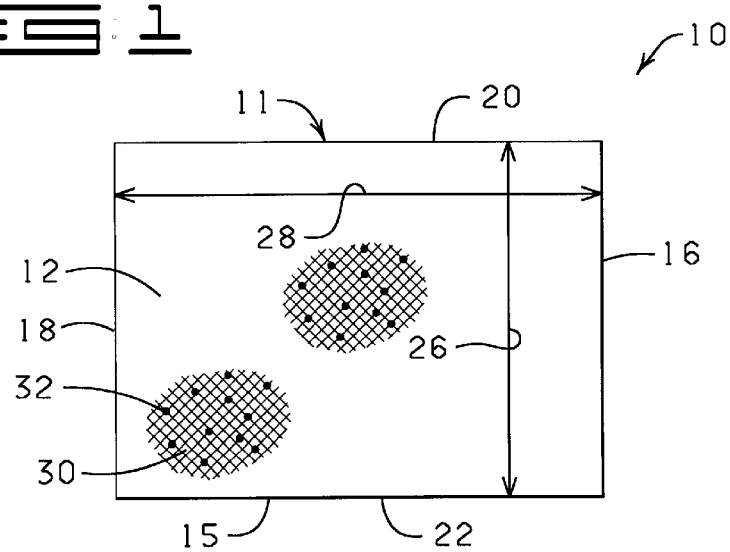
FIG. 2 is a top plan view of the sheet of breathable packaging material constructed in accordance with the present invention.

Turning now to the drawings, and more particularly to FIGS. 1 and 2, designated therein by the general reference numeral 10 is a breathable packaging material. The breathable packaging material 10 comprises a sheet of material 11 having an upper surface 12, a lower surface 14 (FIG. 1), and an outer periphery 15. The sheet of material 11 is further characterized as having a first side 16, a second side 18, a third side 20 and a fourth side 22.

A bonding material 24 may be disposed on the lower surface 14 of the sheet of material 11 as shown in FIG. 1, or the bonding material may be disposed on the upper surface 12 of the sheet of material 11, as shown in FIGS. 8, 9, 20 and 33. Alternatively, however, the sheet of material 11 may be free of a bonding material. The bonding material 24, if present, may be disposed as a strip which extends along one or more sides of the upper surface 12 and/or the lower surface 14 of the sheet of material 11, or the bonding material 24 can be disposed substantially over the upper surface 12 and/or lower surface 14 of the sheet of material 11, or the bonding material 24 can be applied to the upper surface 12 and/or lower surface 14 of the sheet of material 11 in the form of spaced apart spots, or the bonding material 24 also could be disposed on the upper surface 12 and/or lower surface 14 of the sheet of material 11 in any other geometric or non-geometric or asymmetric forms, and in any pattern, including fanciful patterns. One method for disposing a bonding material, in this case an adhesive, on a sheet of material is described in U.S. Pat. No. 5,111,637, entitled, "Method For Wrapping A Floral Grouping", issued to Weder et al. on May 12, 1992 and which is expressly incorporated herein by reference.

The term "bonding material" when used herein means an adhesive, a pressure sensitive adhesive, or a cohesive. Where the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal.

The thickness of the sheet of material 11 can vary widely, as long as the sheet of material 11 is sufficiently flexible to permit the sheet of material 11 to be wrapped about an item as herein described. Generally, however, the sheet of material 11 has a thickness in a range from about 0.1 mil to about 10 mil. Frequently, the sheet of material has a thickness in a range from about 0.2 mil to about 3.5 mil.

The sheet of material 11 may be any shape, and a rectangular shape is shown in FIGS. 1 and 2 only by way of illustration. For example, the sheet of material 11 may be square, circular or any other geometric, non-geometric, asymmetric or fanciful shape, such as heart-shaped.

The sheet of material 11 may be constructed of a single layer of material or a plurality of layers of the same or different types of materials. The layers of material comprising the sheet of material 11 may be laminated together or connected together by any method described herein or known in the art. A bonding material may be used to laminate two or more sheets of material together to form a sheet of material, and the bonding material may also be tinted or colored by using a dye, pigment or ink to provide different coloring effects to the sheet of material. A method for disposing a bonding material in order to laminate two sheets of material as well as a water based ink which may be used to tint the bonding material or one or more sheets of material are described in U.S. Pat. No. 4,297,811, entitled, "Laminated Printed Foil Flower Pot Wrap With Multicolor Appearance," issued to Weder on Nov. 3, 1981.

As shown in FIG. 2, the sheet of material 11 has a length 26 extending between the third and fourth sides 20 and 22, respectively, of the sheet of material 11. The sheet of material 11 also has a width 28 extending between the first and the second sides 16 and 18, respectively, of the sheet of material 11.

The breathable packaging material 10 may further consist of designs or decorative patterns which are printed, etched, and/or embossed on the sheet of material 11 using inks or other printing materials. An example of an ink which may be applied to one or more surfaces of the sheet of material 11 is described in U.S. Pat. No. 5,147,706, entitled, "Water Based Ink On Foil And/Or Synthetic Organic Polymer", issued to Kingman on Sep. 15, 1992 and which is expressly incorporated herein by reference.

The sheet of material 11 may have various colorings, coatings, embossings, flocking, metallic finishes, and/or other decorative surface ornamentation applied separately or simultaneously thereon, or the sheet of material 11 may be characterized totally or partially by pearlescent, translucent, transparent, iridescent, or other finishes. Each of the above-named characteristics may occur alone or in combination and may be applied to the upper surface 12 and/or lower surface 14 of the sheet of material 11. Moreover, each surface of the sheet of material 11 may vary in the combination of such characteristics. The sheet of material 11 may be opaque, translucent, clear, tinted, transparent, or any combination thereof.

In a preferred embodiment, the sheet of material 11 is constructed of a polymeric film having controlled atmosphere characteristics, that is, a polymeric film which is selectively permeable to selected gases such as oxygen, carbon dioxide and ethylene, and impermeable to water and other larger elements such as bacteria, fungus and other parasites. Further, the sheet of material 11 must be capable of being wrapped about a flower pot and/or floral grouping, used as a sleeve or wrapper for a flower pot and/or floral grouping, including, but not by way of limitation, a single item, such as a single flower, a single item of produce, or a single medical supply/equipment.

The term "polymeric film" as used herein means a film formed of a thermo-plastic resinous material, such as, but not by way of limitation, polypropylene. The term "polymeric film" as used herein also means a film formed of a naturally occurring polymer such as cellophane. A polymeric film, as contemplated and described in detail herein, is relatively strong and not as subject to tearing (substantially non-tearable), as might be the case with paper or foil.

The controlled atmosphere characteristics of the polymeric film from which the sheet of material 11 is constructed permit an osmosis of gases such as oxygen, carbon dioxide and ethylene to be exchanged between the environment of the package formed from the breathable packaging material 10 and the outer atmosphere surrounding the package so that a suitable environment for the contents of the package can be maintained at all times. For example, when a plant or floral grouping is packaged in the breathable packaging material 10, such an osmotic balance assures that the plant or floral grouping is continuously provided with necessary gases in the atmosphere immediately surrounding the plant or floral grouping, while harmful gases such as ethylene are not permitted to build up in the package. Thus, the controlled atmosphere characteristics of the sheet of material 11 permits the selected gases to enter or leave the environment within the package, while at the same time preventing the escape of water and the entrance of destructive elements which would damage the contents of the package.

An example of such a polymeric film is HERCULES® B523 oriented polypropylene packaging film, which is available from Hercules Incorporated, Hercules Plaza, Wilmington, Del. 19894. Different polymeric films, or combinations of films, may be utilized according to the contents of the package and the controlled atmosphere desired within such packages, as described in detail below.

Controlled atmosphere film and methods of making said films are disclosed and described in detail in U.S. Pat. No. 4,842,875, entitled, "Controlled Atmosphere Package", issued to H. Anderson on Jun. 27, 1989; U.S. Pat. No. 4,879,078, entitled, "Process For Producing Uniaxial Polyolefin/Filler Films For Controlled Atmosphere Packaging", issued to M. Antoon, Jr. on Nov. 7, 1989; U.S. Pat. No. 4,910,032, entitled, "Water-Permeable Controlled Atmosphere Packaging Device From Cellophane and Microporous Film", issued to M. Antoon, Jr. on Mar. 20, 1990; U.S. Pat. No. 4,923,650, entitled, "Breathable Microporous Film And Methods For Making It", issued to M. Antoon, Jr. et al. on May 8, 1990; U.S. Pat. No. 5,011,698, entitled, "Breathable Microporous Film And Methods For Making It", issued to M. Antoon, Jr., et al. on Apr. 30, 1991; U.S. Pat. No. 5,045,331, entitled, "Container For Controlled Atmosphere Packaging", issued to M. Antoon, Jr. on Sep. 3, 1991; U.S. Pat. No. 5,160,768, entitled, "Curable Silicone-Coated Microporous Films For Controlled Atmosphere Packaging", issued to M. Antoon, Jr. on Nov. 3, 1992; and U.S. Pat. No. 5,254,401, entitled, "Packaging Material For Controlled Atmosphere Packaging", issued to R. Kelch et al. on Oct. 19, 1993, all of which are hereby specifically incorporated by reference herein.

The sheet of material 11 also has a lacquer or coating composition 30 disposed upon at least a portion of one of the surfaces of the sheet of material 11, such as a portion of the upper surface 12, as shown in FIG. 1. The lacquer or coating composition 30, which is preferably a clear acrylic coating composition, contains an effective amount of one or more atmosphere control agents 32. Such atmosphere control agents 32 include: desiccants, such as calcium chloride and silica gel, to reduce excess moisture so that the likelihood of growth of unwanted microorganisms is reduced; antifungal and antimicrobial agents, i.e. agents possessing antifungal properties, antibacterial (bacteriostatic or bacteriocidal) properties, and/or antimicrobial properties which inhibit and/or prevent the growth of fungi, bacteria, algae or other microbes on articles such as a floral grouping, fresh produce, and medical equipment or supplies; and/or non-fogging agents so that the item packaged remains clearly visible through such packaging.

It will be appreciated that the amounts of the atmosphere control agent(s) 32, as well as the choice of the atmosphere control agent(s) 32, incorporated into the lacquer or coating composition 30 is dependent upon the results sought and the nature of the items to be packaged. The duration of action of the atmosphere control agent(s) 32 will depend, in part, upon the particular atmosphere control agent(s) 32 incorporated in the lacquer or coating composition 30, the concentration of the atmosphere control agent(s) 32, and the exposure of the atmosphere control agent(s) 32 to atmospheric conditions. For example, microorganisms will be eliminated or inhibited in the packaged item due to the contact of the antifungal and/or antimicrobial agent present in the lacquer or coating composition 30 on the sheet of material 11 with the item until such time as the antifungal and/or antimicrobial agent is substantially dissipated.

Antifungal and antimicrobial agents which may be utilized with various materials in accordance with the present invention are disclosed and described in detail in U.S. Pat. No. 3,044,885, entitled, "Impregnated Sheets For Preserving Perishable Foodstuffs", issued to B. Loehr on Jul. 17, 1962;

U.S. Pat. No. 3,493,464, entitled, "Fungus-Resistant Paper Containing Metallic Quinolinolate Formed In Situ And Process Thereof", issued to A. Bowers et al. on Feb. 3, 1970; U.S. Pat. No. 3,653,873, entitled, "Ethylenic Sulfilimine Compositions For Controlling Fungi, Bacteria and Algae", issued to H. Bayer on Apr. 4, 1972; U.S. Pat. No. 3,728,213, entitled, "Antibiotic Paper", issued to C. Hinz on Apr. 17, 1973; U.S. Pat. No. 3,864,468, entitled, "Activated Polymer Materials and Process For Making Same", issued to S. Hyman et al. on Feb. 4, 1975; U.S. Pat. No. 3,959,556, entitled, "Antimicrobial Blended Yarns and Fabrics Comprised of Naturally Occurring Fibers", issued to W. Morrison on May 25, 1976; U.S. Pat. No. 3,998,944, entitled, "Fungicidal Paper", issued to W. Long on Dec. 21, 1976; U.S. Pat. No. 4,008,351, entitled, "Film Or Sheet Material Having Antibacterial And Antifungal Activities", issued to M. Inoue et al. on Feb. 15, 1977; U.S. Pat. No. 4,111,922, entitled, "Hydrophilic Random Interpolymer From Quaternary Ammonium Monomers And Method For Making Same", issued to C. Beede et al. on Sep. 5, 1978; U.S. Pat. No. 4,343,853, issued to W. Morrison on Aug. 10, 1982; U.S. Pat. No. 4,401,712, entitled, "Antimicrobial Non-Woven Fabric", issued to W. Morrison on Aug. 30, 1983; U.S. Pat. No. 4,533,435, entitled, "Antimicrobial Paper", issued to H. Intili on Aug. 6, 1985; U.S. Pat. No. 4,663,077, entitled, "Microbiocidal Compositions Comprising An Aryl Alkanol And A Microbiocidal Compound Dissolved Therein", issued to N. Rei et al. on May 5, 1987; U.S. Pat. No. 4,666,706, entitled, "Delayed Release Insecticidal Composition And Method Of Making Same", issued to R. Farquharson et al. on May 19, 1987; U.S. Pat. No. 4,743,448, entitled, "Organic Carrier With Integrated Active Substances", issued to M. Bahadir et al. on May 10, 1988; U.S. Pat. No. 4,888,175, entitled, "Aseptic Packaging", issued to K. Burton, Jr. et al. on Dec. 19, 1989, and U.S. Pat. No. 5,242,052, entitled, "Antimicrobial Material And Methods", issued to D. Weder on Sep. 7, 1993, all of which are hereby specifically incorporated by reference herein.

As previously stated, the atmosphere control agent 32 may be an non-fogging agent. The non-fogging agent will prevent any decrease in visibility of the contents of the package and will prevent any decrease in the amount of light transmitted to the contents of the package, such as a plant contained therein, thereby permitting retailers and consumers to visually examine the contents of the package clearly. Examples of non-fogging agents include polyvinyl chloride, silicone and fluorochemical coatings.

It will further be appreciated that the precise amount of non-fogging agent used is dependent upon the results sought and the items to be packaged. Generally, fogging of the packaging will be eliminated or inhibited in the packaged item due to the contact of the non-fogging agent present in the lacquer or coating composition 30 with the item until such time as the non-fogging agent is substantially dissipated. The duration of action of the non-fogging agent will depend, in part, upon the agent(s) used, the concentration of the agent(s) used, and the exposure of the agent(s) to atmospheric and/or packaged conditions.

The atmosphere control agent 32 may be incorporated into the lacquer or coating composition 30 in any suitable manner, and the lacquer or coating composition 30 may be applied to the sheet of material 11 in any suitable manner, such as by spraying, brushing and the like. Alternatively, the atmosphere control agent(s) 32 may be incorporated into the sheet of material 11 before or during formation of the sheet of material 11.

Optionally, the sheet of material 11 may be free of the lacquer or coating composition 30, and the atmosphere control agent(s) 32 may be mixed with or incorporated in the bonding material 24 disposed on at least a portion of at least one of the upper and lower surfaces 12 and 14 of the sheet of material 11. Methods for mixing and incorporation are known in the art, as are methods of disposing bonding material 24 on sheets of material 11.

The atmosphere control agents 32 may alternatively be disposed in the lacquer or coating composition 30 or the bonding material 24 via microcapsules. Suitable microcapsules and methods which may be utilized with the above-referenced materials (i.e., desiccants, antifungal and antimicrobial agents and/or non-fogging agents) are disclosed and described in detail in U.S. Pat. No. 4,990,381, entitled, "Multi-Layer Sandwich Sheet and Packaging Using The Said Sheet", issued to G. Holzner on Feb. 5, 1991; U.S. Pat. No. 4,988,557, entitled, "Fragrance Sampling Device", issued to J. Charbonneau on Jan. 29, 1991; U.S. Pat. No. 4,925,517, entitled, "Method Of Forming Fragrance Releasing Pull-Apart Sheets", issued to J. Charbonneau et al. on May 15, 1990; U.S. Pat. No. 4,848,929, entitled, "Volatile Emitting Container", issued to H. Rawl on Jul. 18, 1989; U.S. Pat. No. 4,769,264, entitled, "On Page Fragrance Sampling Device", issued to R. Dreger on Sep. 6, 1988; U.S. Pat. No. 4,661,388, entitled, "Pad Fragrance Sampling Device", issued to J. Charbonneau on Apr. 28, 1987; U.S. Pat. No. 4,606,956, entitled, "On Page Fragrance Sampling Device", issued to J. Charbonneau et al. on Aug. 19, 1986; and U.S. Pat. No. 4,528,226, entitled, "Stretchable Microfragrance Delivery Article", issued to N. Sweeny on Jul. 9, 1985, all of which are hereby specifically incorporated by reference herein.

It will be appreciated that the lacquer or coating composition 30 or the bonding material 24 containing one or more atmosphere control agents 32 may cover a substantial portion of at least one of the upper and lower surfaces 12 and 14 of the sheet of material 11 as long as the sheet of material 11, when wrapped about an item, provides a package having the desired permeability to selected substances and/or gases so as to provide a desired atmosphere in the package. Alternatively, the lacquer or coating composition 30 or the bonding material 24 containing one or more of the atmosphere control agents 32 may cover only limited portions of at least one of the upper and lower surfaces 12 and 14 of the sheet of material 11. The lacquer or coating composition 30 or the bonding material 24 containing one or more of the atmosphere control agents 32 may be applied to at least a portion of a second sheet of material (not shown) which can then be connected to the sheet of material 11.

Figure 3:
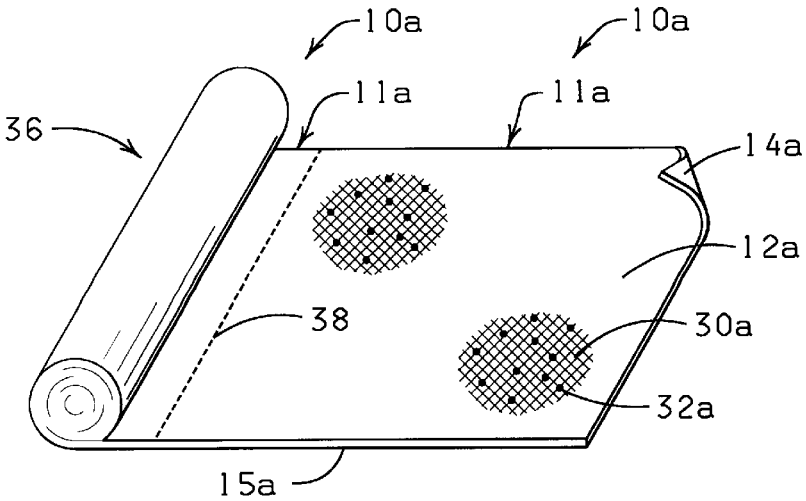
FIG. 3 is a perspective view of a roll of breathable packaging material containing a plurality of sheets of breathable packaging material separated by perforations.
Figure 4:
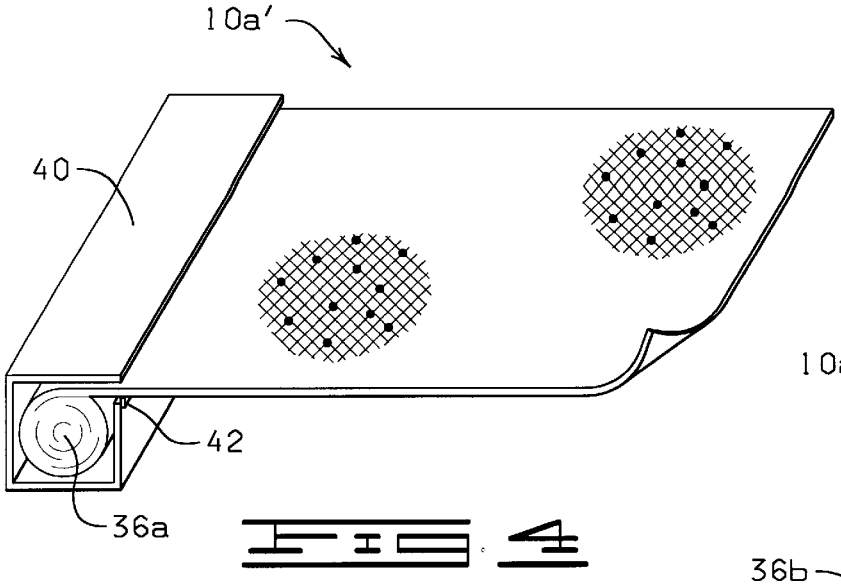
FIG. 4 is a perspective view showing a roll of breathable packaging material wherein the roll of breathable packaging material is disposed in a dispenser.
Figure 5:
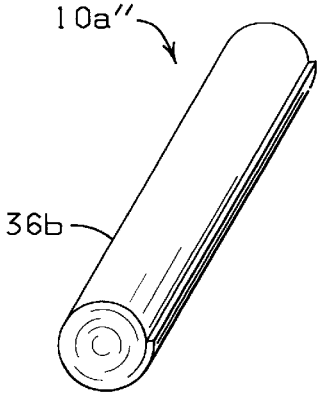
FIG. 5 is a perspective view showing a roll of breathable packaging material wherein the roll comprises a single sheet of breathable packaging material.

Description of FIGS. 3–5

Referring now to FIG. 3, a breathable packaging material 10*a* is shown. The breathable packaging material 10*a* comprises a sheet of material 11*a* having an upper surface 12*a*, a lower surface 14*a*, and an outer periphery 15*a*. The sheet of material 11*a* also has a lacquer or coating composition 30*a* which is disposed upon at least a portion of one of the upper and lower surfaces 12*a* and 14*a* of the sheet of material 11*a*, such as a portion of the upper surface 12*a* of the sheet of material 10*a*. The lacquer or coating composition 30*a*, which is preferably a clear acrylic coating composition, contains an effective amount of one or more atmosphere control agents 32*a*. However, it will be understood that a bonding material 24*a* may be disposed on at least a portion of at least one of the upper and lower surfaces 12*a* and 14*a* of the sheet of material 11*a*, and the atmosphere control agent(s) 32*a* may be incorporated in the bonding material 24*a* rather than the lacquer or coating composition

30*a* ; in this manner, the sheet of material 11*a* may be free of the lacquer or coating composition 30*a*.

The breathable packaging material 10*a* is substantially similar to the breathable packaging material 10 shown in FIGS. 1 and 2 and described in detail previously, except in the breathable packaging material 10*a* is formed into a plurality of individual sheets of breathable packaging material 10*a* which are connected linearly together to form a roll 36. Preferably, the plurality of sheets of breathable packaging material 10*a* in the roll 36 are connected by perforations 38, as illustrated in FIG. 3, so that one sheet of breathable packaging material 10*a* can be withdrawn from the roll 36 and then severed or disconnected from the roll 36 via the perforations 38.

Shown in FIG. 4 is a roll 36*a* of breathable packaging material 10*a*' which is substantially similar to the roll 36 of breathable packaging material 10*a* described herein before with respect to FIG. 3, except that the roll 36*a* of breathable packaging material 10*a*' is formed as a continuous roll of breathable packaging material 10*a*' without perforations so that one or more sheets of breathable packaging material 10*a*' can be removed from the roll 36*a* by unrolling a portion of the breathable packaging material 10*a*' from the roll 36*a* and thereafter severing the unrolled breathable packaging material 10*a*' to provide the sheet of breathable packaging material 10*a*'.

The roll 36*a* is contained within a dispenser 40, as illustrated in FIG. 4, and in use, a portion of the breathable packaging material 10*a*' is unrolled, and a serrated cutting edge 42 of the dispenser 40, or a separate cutting element (not shown), can be used to sever the unrolled portion of the roll 36*a* to provide the sheet of breathable packaging material 10*a*'.

It will be understood that any number of sheets of breathable packaging material 10*a* may form a roll 36 as long as it is possible to withdraw at least one sheet of breathable packaging material 10*a* from the roll 36 as described herein. A roll 36*b* formed of one sheet of breathable packaging material 110*a*' is shown in FIG. 5.

Figure 6:
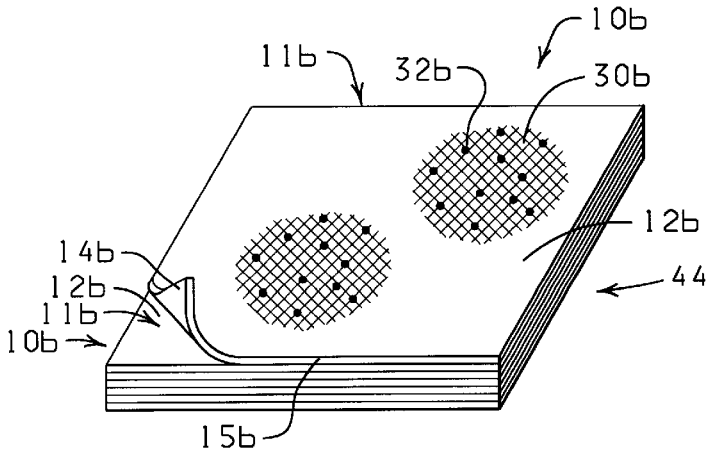
FIG. 6 is a perspective view of a pad of sheets of breathable packaging material constructed in accordance with the present invention, showing an edge of a top sheet of breathable packaging material lifted so as to expose a portion of a sheet of breathable packaging material disposed below the top sheet of breathable packaging material.
Figure 7:
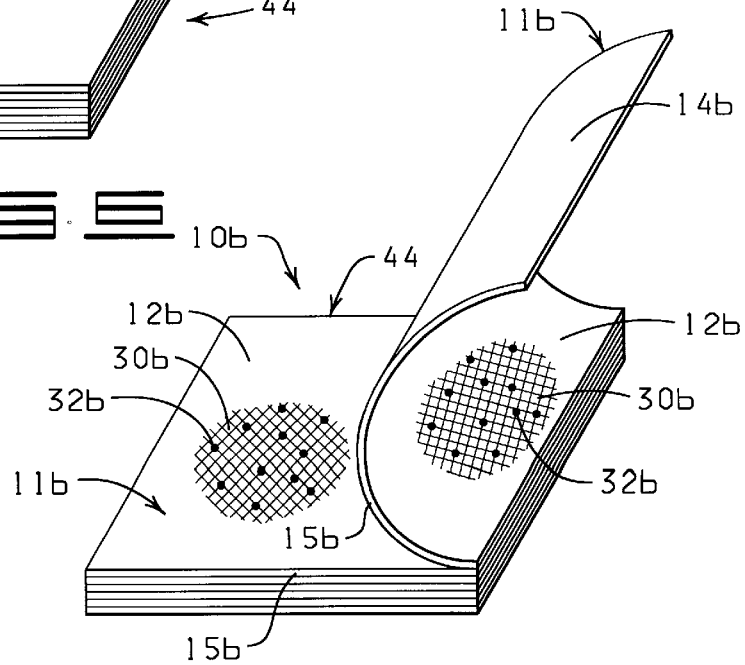
FIG. 7 is a perspective view of the pad of sheets of breathable packaging material shown in FIG. 6, but showing the top sheet of breathable packaging material being detached from the pad of sheets of breathable packaging material.

Description of FIGS. 6 and 7

Shown in FIG. 6 is a pad 44 comprising a plurality of sheets of breathable packaging material 10*b* which are stacked and aligned one on top of the other. Each of the sheets of breathable packaging material 10*b* in the pad 44 comprises a sheet of material 11*b* which has an upper surface 12*b*, a lower surface 14*b* and an outer periphery 15*b*. Further, each of the sheets of material 11*b* also has a lacquer or coating composition 30*b* disposed upon at least a portion of the sheet of material 11*b*, such as the upper surface 12*b* of the sheet of material 11*b* as shown in FIGS. 6 and 7. The lacquer or coating composition 30*b*, which is preferably a clear acrylic coating composition, is disposed on at least a portion of at least one of the upper and lower surfaces 12*b* and 14*b* of the sheet of material 11*b* and contains an effective amount of one or more atmosphere control agents 32*b*. However, it will be understood that the sheet of material 11*b* may be provided with a bonding material 2 4*b* disposed thereon, and the atmosphere control agent(s) 32*b* may be incorporated in the bonding material 24*b* rather than the lacquer or coating composition 30*b* ; in this manner, the sheet of material 11*b* may be free of the lacquer or coating composition 30*b*.

Thus, the breathable packaging material 10*b* is substantially similar to the breathable packaging material 10 shown in FIGS. 1 and 2 and described in detail previously, except that the breathable packaging material 10*b* is provided in the form of the pad 44.

The sheets of breathable packaging material 10*b* are connected together along one side via a bonding material, such as a pressure sensitive adhesive (not shown). When the top sheet of breathable packaging material 10*b* is lifted and removed from the pad 44, as shown in FIG. 7, the next sheet of breathable packaging material 10*b* becomes the new top sheet of breathable packaging material 10*b* of the pad 44. This process is repeated, until all of the sheets of breathable packaging material 10*b* in the pad 44 are removed.

In operation, a floral grouping or flower pot may be placed on the top sheet of material 11*b* in the pad 44 and the top sheet of material 11*b* may be wrapped about the floral grouping or flower pot and removed from the pad 44. Methods for forming a pad, using the sheets of material to wrap floral groupings, and removing sheets from a pad are known in the art. Methods of both forming a pad and wrapping floral groupings with sheets of material from a pad are described in U.S. Pat. No. 5,181,364, entitled, "Wrapping A Floral Grouping With Sheets Having Adhesive Or Cohesive Material Applied Thereto", issued to Weder on Jan. 26, 1993, which is hereby incorporated by reference herein.

Description of FIGS. 8–14

Turning now to FIGS. 8–11, a breathable packaging material 10*c* constructed in accordance with the present invention may be used to wrap a floral grouping 64 having a bloom or foliage portion 66 and a stem portion 68.

The term "floral grouping" as used herein is to be understood to mean cut fresh flowers, artificial flowers, a single flower, other fresh and/or artificial plants or other floral materials and may include secondary plants and/or ornamentation or artificial or natural materials which add to the aesthetics of the overall floral arrangement. The term "floral grouping" may be used interchangeably herein with the term "floral arrangement".

The breathable packaging material 10*c* comprises a sheet of material 11*c* constructed of a polymeric film having controlled atmosphere characteristics as herein before described, that is, a film which is permeable to selected substances and/or gases, but impermeable to others. The sheet of material 11*c* is characterized as having an upper surface 12*c*, a lower surface 14*c* (FIG. 9) and an outer periphery 15*c*. The sheet of material 11*c* is further characterized as having a first side 16*c*, a second side 18*c*, a third side 20*c* and a fourth side 22*c*. A strip of bonding material 24*c* is disposed on the upper surface 12*c* of the sheet of material 11*c* near the third side 20*c* of the sheet of material 11*c*, the strip of bonding material 24*c* extending between the first side 16*c* and the second side 18*c* of the sheet of material 11*c*.

Figure 8:
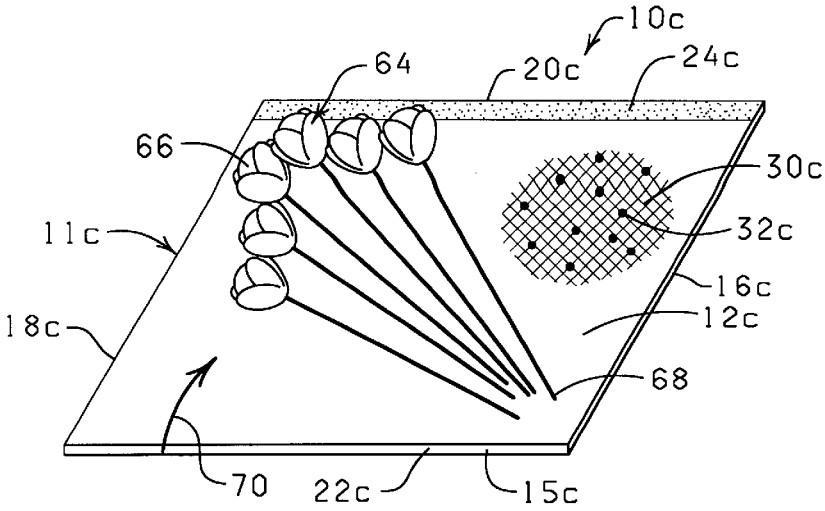
FIG. 8 is a perspective view of a floral grouping disposed on a sheet of breathable packaging material constructed in accordance with the present invention.

The sheet of material 11*c* also has a lacquer or coating composition 30*c* which is disposed upon at least a portion of the sheet of material 11*c*, such as a portion of the upper surface 12*c* as shown in FIG. 8. The lacquer or coating composition 30*c*, which is preferably a clear acrylic coating composition, contains an effective amount of one or more atmosphere control agents 32*c*, such as desiccants, antifungal and antimicrobial agents and/or non-fogging agents. However, it will be understood that the sheet of material 11*c* may not be provided with a lacquer or coating composition 30*c* disposed thereon, and the atmosphere control agent(s) 32*c* may be incorporated in the bonding material 24*c*.

Figure 9:
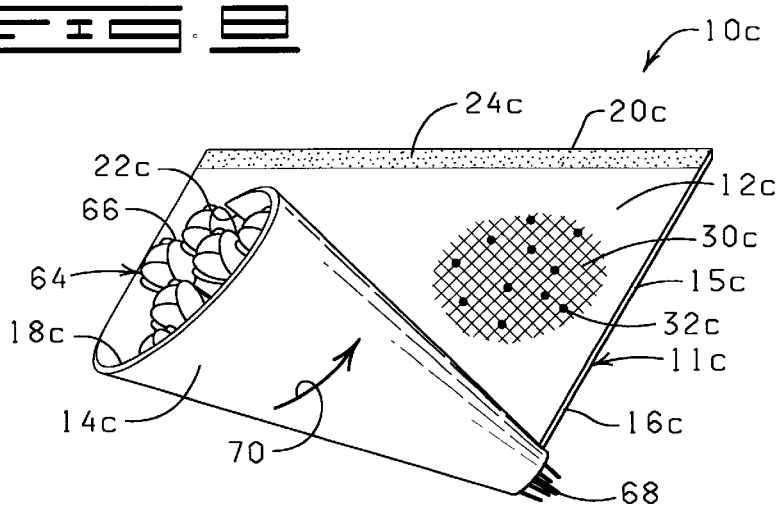
FIG. 9 is a perspective view of the floral grouping of FIG. 8 being wrapped in the sheet of breathable packaging material by one method of wrapping.
Figure 10:
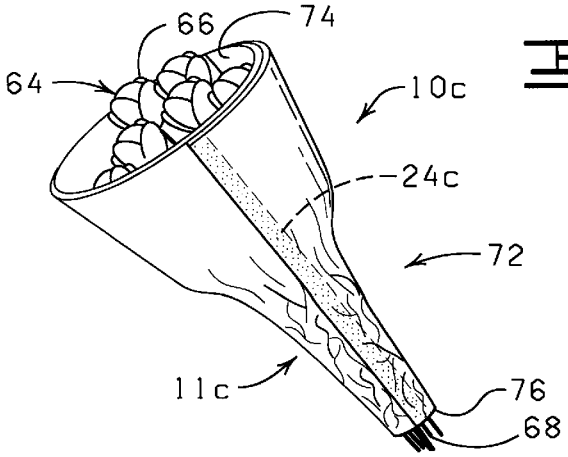
FIG. 10 is a perspective view of the floral grouping of FIGS. 8 and 9 wrapped in the sheet of breathable packaging material in a conical fashion, thereby form a decorative wrapper.

In a method of use as shown in FIGS. 8–10, the floral grouping 64 is disposed on the upper surface 12*c* of the sheet of material 11*c*. The sheet of material 11*c* is then wrapped about the floral grouping 64 by taking the fourth side 22*c* of the sheet of material 11*c* and rolling the sheet of material 11*c* in a direction indicated by the arrow 70 about the floral grouping 64. The sheet of material 11*c* is continued rolled about the floral grouping 64 until a portion of the bonding material 24*c* is disposed adjacent a portion of the lower surface 14*c* of the sheet of material 11*c* and brought into bonding contact or engagement therewith thereby bondingly connecting the bonding material 24*c* on the upper surface 12*c* of the sheet of material 11*c* to a portion of the lower surface 14*c* of the sheet of material 11*c* for cooperating to secure the sheet of material 11*c* in a wrapped condition about the floral grouping 64 to provide a conically-shaped decorative wrapper 72 for the floral grouping 64, as shown in FIG. 10.

As shown in FIG. 10, the conically-shaped decorative wrapper 72 is provided with an open upper end 74 and an open lower end 76. The conically-shaped decorative wrapper 72 covers a portion of the bloom portion 66 of the floral grouping 64, and a portion of the stem portion 68 of the floral grouping 64 extends through the open lower end 76 of the conically-shaped decorative wrapper 72. The portion of the conically-shaped decorative wrapper 72 disposed about the stem portion 68 of the floral grouping 64 is tightly wrapped about the stem portion 68 of the floral grouping 64. The bonding material 24*c* on the sheet of material 11*c* may contact and engage some of the stem portion 68 of the floral grouping 64 to cooperate in securing the conically-shaped decorative wrapper 72 in a tightly wrapped position about the stem portion 68 of the floral grouping 64 and to prevent the floral grouping 64 from slipping or moving within the conically-shaped decorative wrapper 72.

At least a portion of the floral grouping 64 is disposed within the conically-shaped decorative wrapper 72. In some applications, the stem portion 68 of the floral grouping 64 extends through the open lower end 76 of the conically-shaped decorative wrapper 72 and a portion of the conically-shaped decorative wrapper 72 is tightly wrapped about the stem portion 68 of the floral grouping 64, as described before. In other applications, the stem portion 68 does not extend through the open lower end 76 of the decorative wrapper 72. The bloom portion 66 of the floral grouping 64 may be disposed near the open upper end 74 of the conically-shaped decorative wrapper 72 so that the bloom portion 66 of the floral grouping 64 is visible via the open upper end 74 of the conically-shaped decorative wrapper 72. In some instances, the bloom portion 66 of the floral grouping 64 may extend beyond the open upper end 74 of the conically-shaped decorative wrapper 72. It will be appreciated that the open upper end 74 of the conically-shaped decorative wrapper 72 may be closed by a flap (not shown) or any other method known in the art. Similarly, it will be understood that the open lower end 76 of the conically-shaped decorative wrapper 72 may be closed in the same manner as that described for the open upper end 74. It will be further appreciated that the floral grouping 64 may be sealed within the conically-shaped decorative wrapper 72, or within any decorative wrapper and/or package shown and/or described herein.

Figure 11:
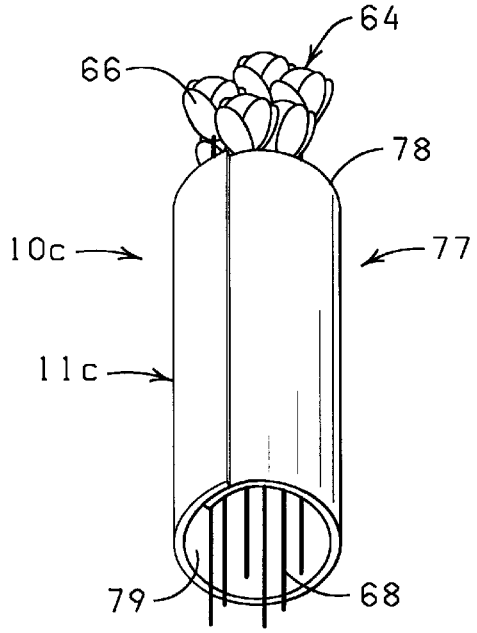
FIG. 11 is a perspective view of another method of using a sheet of breathable packaging material to wrap a floral grouping in a cylindrical fashion.

The sheet of material 11*c* may also be wrapped about the floral grouping 64 to form a cylindrically shaped decorative wrapper 77 as shown in FIG. 11 wherein the bloom portion 66 of the floral grouping 64 is disposed near an open upper end 78 of the cylindrically shaped decorative wrapper 77, and a lower end of the stem portion 68 of the floral grouping 64 extends through an open lower end 79 of the floral grouping 64. While the conically shaped decorative wrapper 72 has been illustrated in FIG. 10 and the cylindrically shaped decorative wrapper 77 has been illustrated in FIG. 11, it should be understood that the breathable packing material may be formed into any other shape of decorative wrapper desired in a particular application.

U.S. Pat. No. 5,181,364, entitled, "Wrapping A Floral Grouping With Sheets Having An Adhesive Or Cohesive Material Applied Thereto", issued to Weder et al. on Jan. 26, 1993, which has been incorporated by reference 20 herein above, discloses methods of wrapping a floral grouping in a cylindrically-shaped decorative wrapper.

Figure 12:
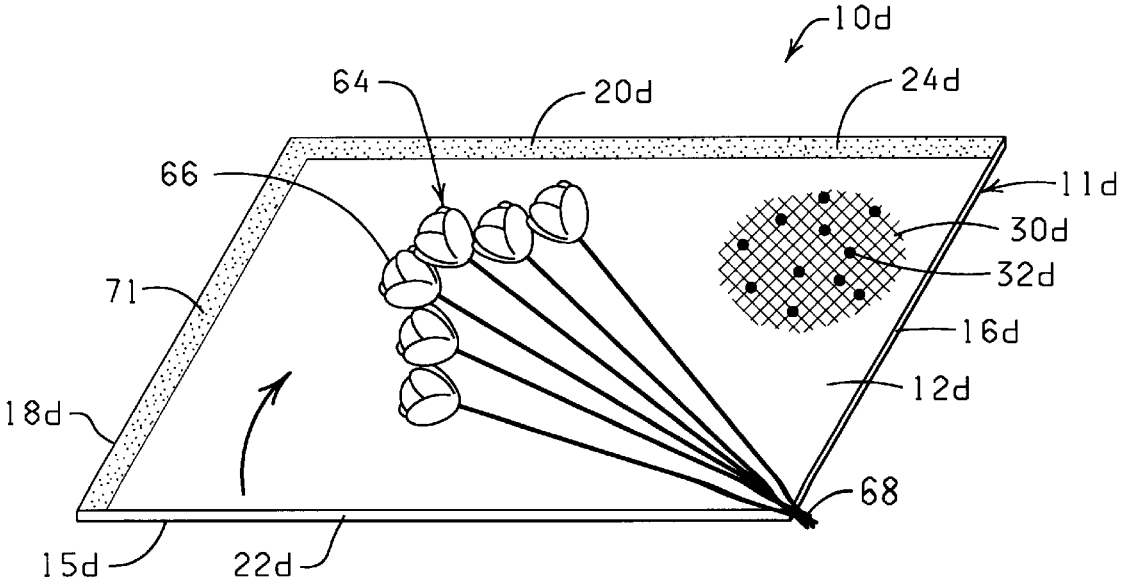
FIG. 12 is a perspective view of a floral grouping disposed on a sheet of breathable packaging material constructed in accordance with the present invention.
Figure 13:
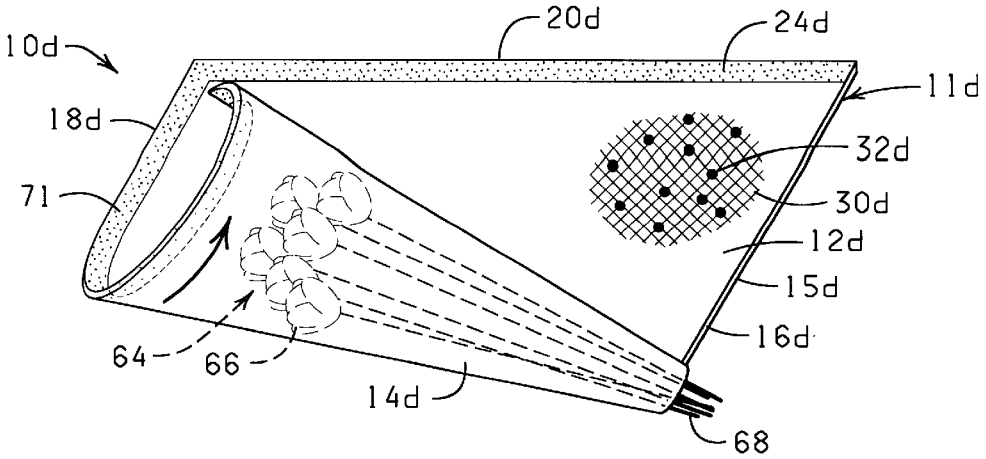
FIG. 13 is a perspective view of the floral grouping of FIG. 12 being wrapped in the sheet of breathable packaging material.
Figure 14:
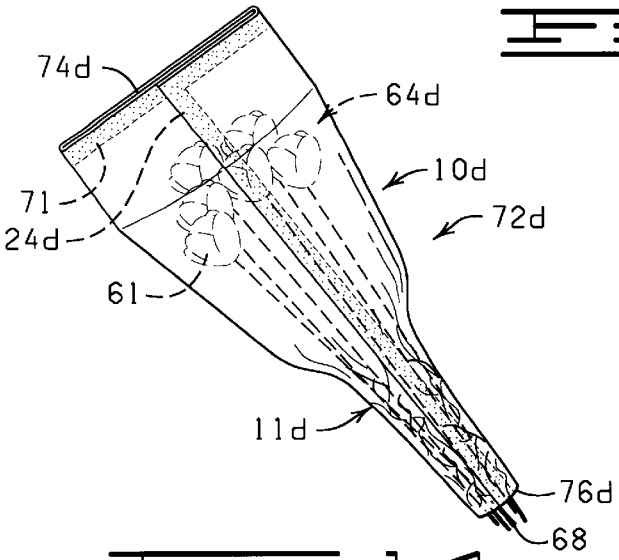
FIG. 14 is a perspective view of the floral grouping of FIGS. 12 and 13 wrapped in the sheet of breathable packaging material to form a decorative wrapper, wherein an upper end of the decorative wrapper is sealed about a bloom portion of the floral grouping.

As stated above, the upper end of a decorative wrapper may be sealed, thereby sealing the bloom portion 66 of the floral grouping 64 in the decorative wrapper. Shown in FIGS. 12–14 is a breathable packaging material 10*d* which may be utilized to seal the floral grouping 64 in a decorative wrapper 72*d* formed therefrom. The breathable packaging material 10*d* is substantially similar to the breathable packaging material 10*c* described herein before with reference to FIGS. 8–11, except as described herein below. The breathable packaging material 10*d* comprises a sheet of material 11*d* which is characterized as having an upper surface 12*d*, a lower surface 14*d*, a first side 16*d*, a second side 18*d*, a third side 20*d* and a fourth side 22*d*. The breathable packaging material 10*d* further comprises a bonding material 24*d* disposed as a strip on a portion of the upper surface 12*d* of the sheet of material 11*d*, wherein the bonding material 24*d* is disposed adjacent the third side 20*d* of the sheet of material 11*d* and extends between the first and second sides 16*d* and 18*d*, respectively, of the sheet of material 11*d*. The breathable packaging material 10*d* also comprises a lacquer or coating composition 30*d* disposed on at least a portion thereof, such as the upper surface 12*d* thereof as shown in FIGS. 12 and 13, and the lacquer or coating composition 30*d* contains at least one atmosphere control agent 32*d*, wherein the lacquer or coating composition 30*d* and the atmosphere control agent(s) 32*d* are substantially similar to the lacquer or coating composition 30 and the atmosphere control agent(s) 32 described hereinbefore.

In addition, the breathable packaging material 10*d* further comprises an additional strip of bonding material 71 which is disposed on at least a portion of the upper surface 12*d* of the sheet of material 11*d*, the bonding material 71 being adjacent to the second side 18*d* of the sheet of material 11*d* and extending between the third side 20*d* and the fourth side 22*d* thereof.

In a method of use shown in FIGS. 12–14, the floral grouping 64 is disposed on the upper surface 12*d* of the sheet of material 11*d*, and the sheet of material 11*d* wrapped thereabout to form the decorative wrapper 72*d* in a manner substantially similar to that described herein above for wrapping the sheet of material 11*c* about the floral grouping 64 (as shown in FIGS. 8–10), except that the bloom portion 66 of the floral grouping 64 is substantially surrounded by and encompassed in the decorative wrapper 72*d* and is disposed below an upper end 74*d* of the decorative wrapper 72*d*.

As shown in FIG. 14, the bonding material 71 disposed adjacent the second side 18*d* of the sheet of material 11*d* may then bondingly connect to another portion of the sheet of material 11*d* at a position above the bloom portion 66 of the floral grouping 64, thereby sealing the upper end 74*d* of the decorative wrapper 72*d*. In this manner, the bloom portion 66 of the floral grouping 64 can be sealed in the decorative wrapper 72*d*. A lower end 76*d* of the decorative wrapper 72*d* may be open as shown in FIG. 14, or the lower end 76*d* of the decorative wrapper 72*d* can be sealed about the stem portion 68 of the floral grouping 64 in a similar manner as that described above for sealing the upper end 74*d* of the decorative wrapper 72*d*. A floral assembly comprises the floral grouping 64 sealed in the decorative wrapper 72*d*.

Description of FIGS. 15–22

Referring now to FIGS. 15–18, as noted above, a breathable packaging material 10*e* may be used to provide a decorative cover 80 for an object such as a flower pot 82 or a potted plant. The flower pot 82 has an open upper end 84, a closed lower end 86, an outer peripheral surface 88, an inner peripheral surface 92 and a retaining space 94.

The term "flower pot" refers to any type of container used for holding a floral grouping or a potted plant. Examples of flower pots 82 used in accordance with the present invention include, but not by way of limitation, clay pots, plastic pots, wooden pots, pots made from natural and/or synthetic fiber, and the like.

The breathable packaging material 10*e* is substantially similar to the breathable packaging material 10 shown in FIGS. 1 and 2, except that a sheet of material 11*e* of the breathable packaging material 10*e* has either a bonding material 24*e* disposed substantially thereon, or is formed at least partially from a shape-sustaining material, or both. In addition, the sheet of material 11*e* is provided with a lacquer or coating composition 30*e* containing an effective amount of at least one atmosphere control agent 32*e*. However, it will be understood that the atmosphere control agent(s) 32*e* may be incorporated in the bonding material 24*e* rather than the lacquer or coating composition 30*e*.

To cover an object, the breathable packaging material 10*e* may be manually or automatically formed about the outer peripheral surface 88 of the flower pot 82 or potted plant to form the decorative cover 80. Alternatively, the breathable packaging material 10*e* may be formed into a preformed decorative cover 95 (FIG. 19) which is then placed about the outer peripheral surface 88 of the flower pot 82 or potted plant.

Figure 15:
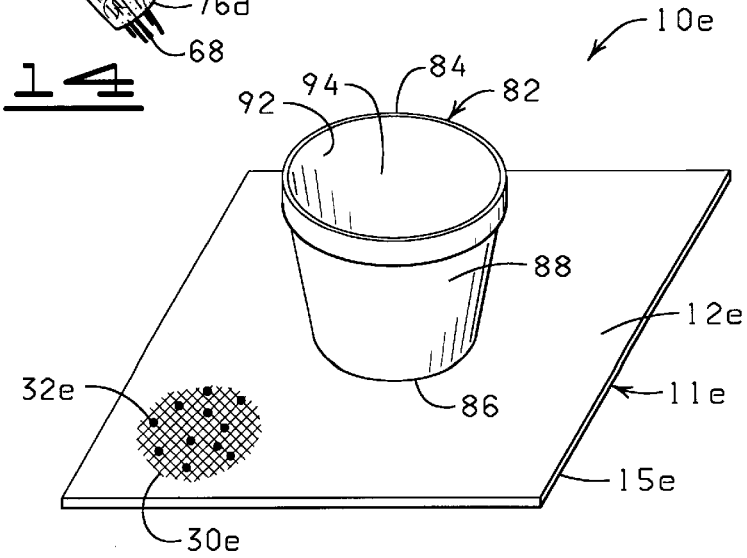
FIG. 15 is a perspective view of a sheet of breathable packaging material of the present invention having a flower pot disposed thereon.
Figure 16:
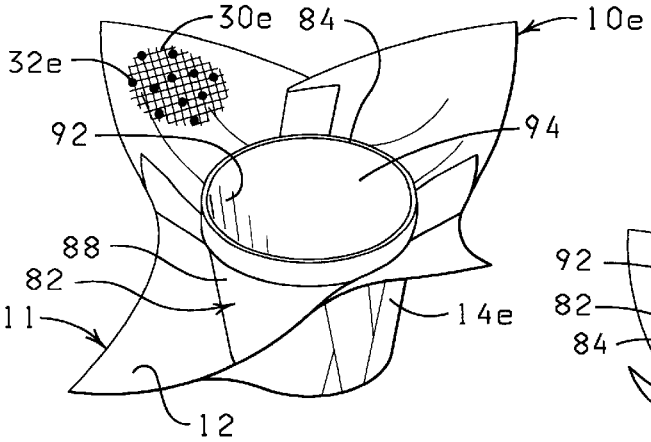
FIG. 16 is a perspective view of the sheet of breathable packaging material of FIG. 15 showing the sheet of material partially wrapped about the flower pot.
Figure 17:
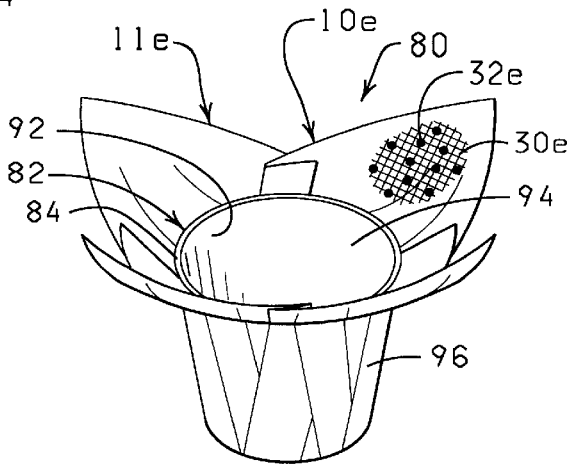
FIG. 17 is a perspective view of the sheet of breathable packaging material of FIGS. 15 and 16 wrapped about the flower pot.

In a method of use, referring to FIGS. 15–17, to form the breathable packaging material 10*e* into a decorative cover 80 about the flower pot 82, both the flower pot 82 and the breathable packaging material 10*e* are provided. The flower pot 82 is disposed upon an upper surface 12*e* of the sheet of material 11*e*, so that the closed lower end 86 of the flower pot 82 rests upon a portion of the upper surface 12*e* of the sheet of material 11*e*.

Figure 18:
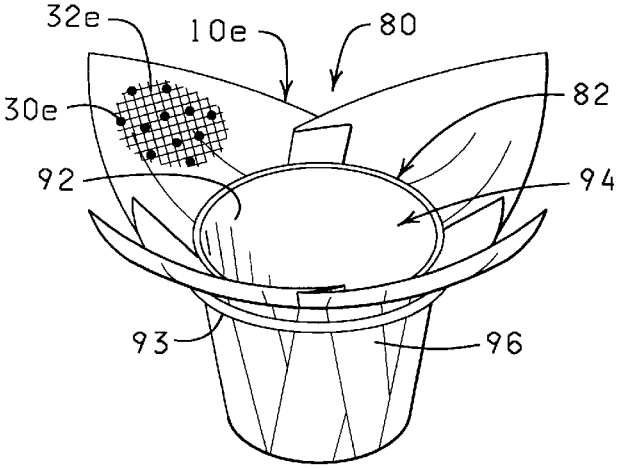
FIG. 18 is a perspective view of a decorative pot cover formed from a sheet of breathable packaging material which is secured about a flower pot with a band.

In one embodiment of a manual application of the breathable packaging material 10*e* about the flower pot 82, the sheet of material 11*e* is formed about the outer peripheral surface 88 of the flower pot 82 (FIGS. 16–18), thereby engaging the outer peripheral surface 88 of the flower pot 82 to form a decorative cover 80 about the flower pot 82 as shown in FIGS. 17 and 18, in a manner which is known to those having ordinary skill in the art. A lower surface 14*e* of the sheet of material 11*e* thereby becomes an outer surface 96 of the decorative cover 80.

A method for forming the sheet of material 11*e* about the flower pot 82 to provide the decorative cover 80 for the flower pot 82 is shown in U.S. Pat. No. 4,733,521, entitled, "Cover Forming Apparatus", issued to Weder et al., on Mar. 29, 1988, which is hereby incorporated herein by reference. The decorative cover 80 formed from the breathable packaging material 10*e* may be secured about the outer peripheral surface 88 of the flower pot 82 by the use of one or more bonding materials described herein. One particular method of securing the decorative cover 80 about the flower pot 82 is by applying a band 93 about the flower pot 82 to hold the decorative cover 80 in place, such as is shown in FIG. 18 or described in U.S. Pat. No. 5,105,599, entitled "Means For Securing A Decorative Cover About A Flower Pot", issued to Weder on Apr. 21, 1992 and which is hereby expressly incorporated herein by reference.

The term "band" when used herein refers to any material which may be secured about an object such as a flower pot, such bands commonly being referred to as elastic bands or non-elastic bands and also includes any other type of material such as an elastic or non-elastic string or elastic piece of material, non-elastic piece of material, a round piece of material, a flat piece of material, a ribbon, a piece of paper strip, a piece of plastic strip, a piece of wire, a tie wrap or a twist tie or combinations thereof or any other device capable of gathering the sheet of material to removably or substantially permanently form a crimped portion and secure the crimped portion formed in the sheet of material which may be secured about an object such as the flower pot. The band also may include a bow if desired in a particular application.

Figure 19:
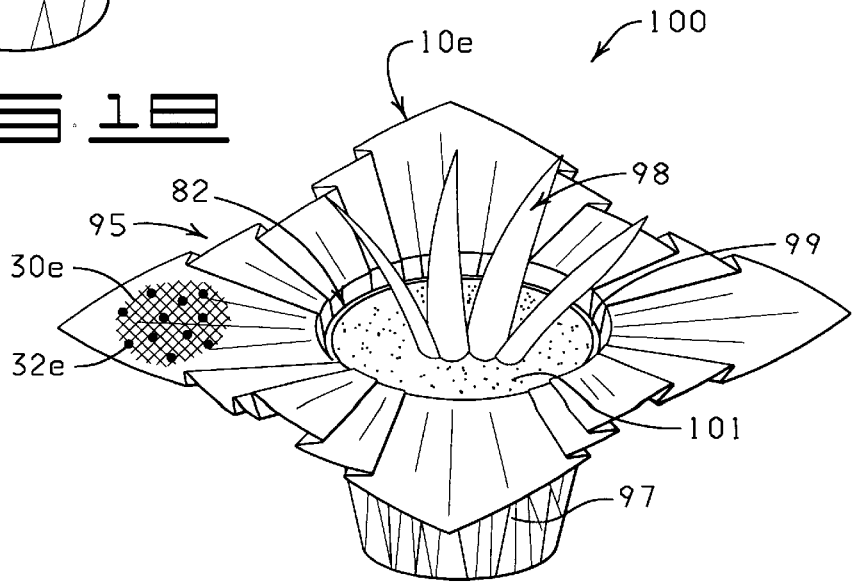
FIG. 19 is a perspective view of a potted plant disposed in a preformed decorative pot cover constructed in accordance with the present invention.

Alternatively, the breathable packaging material 10*e* may be preformed into the decorative cover 95 having an opening 99 as shown in FIG. 19. It should be understood that the preformed decorative cover 95 can be provided with a configuration substantially corresponding to the configuration of the decorative cover 80 shown in FIGS. 17 and 18, or any other ornamental configuration desired. The preformed decorative cover 95 is self-supporting by virtue of overlapping folds 97, at least a portion of which are bonded to each other, thereby forming a rigid structure, as shown in FIG. 19. It will be appreciated that because the preformed decorative cover 95 is self-supporting, it has structural features similar to those previously described for the flower pot 82. Thus, a plant 98 and growing medium 101 contained in the flower pot 82 can be disposed into the opening 99 of the preformed decorative cover 95, thereby resulting in a decoratively covered potted plant 100 as shown in FIG. 19. Alternatively, the preformed decorative cover 95 may be used instead of the flower pot 82. That is, the plant 98 and growing medium 101 may be disposed in the preformed decorative cover 95 directly instead of disposing the plant 98 and growing medium 101 in a flower pot 82 prior to disposal in the preformed decorative cover 95, thereby eliminating the need for the flower pot 82.

One method for forming such a preformed decorative plant cover or pot cover is shown in U.S. Pat. No. 4,773,182, entitled, "Article Forming System", issued to Weder et al. on Sep. 27, 1988, which is hereby incorporated herein by reference.

Figure 20:
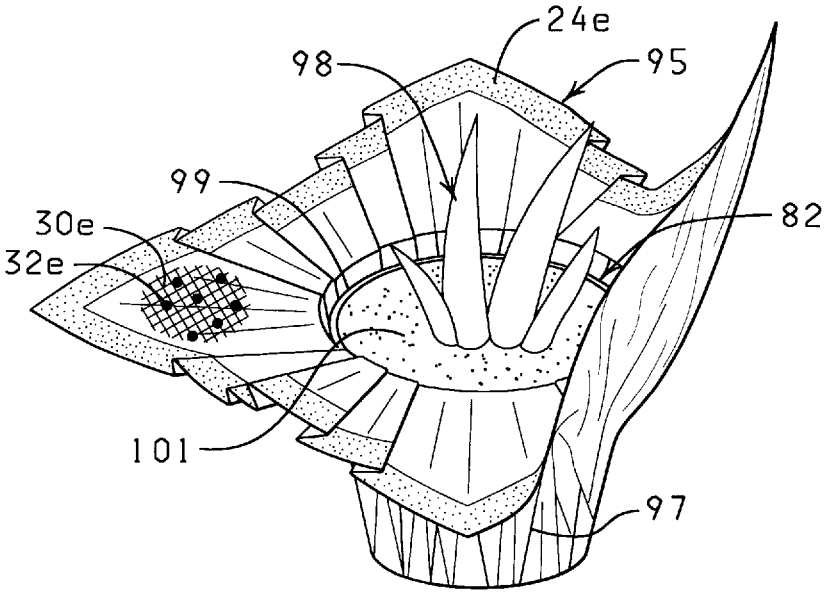
FIG. 20 is a perspective view of a decorative cover for a floral grouping contained within a pot, the decorative cover being capable of being sealed so as to form a breathable package about the pot and floral grouping.
Figure 21:
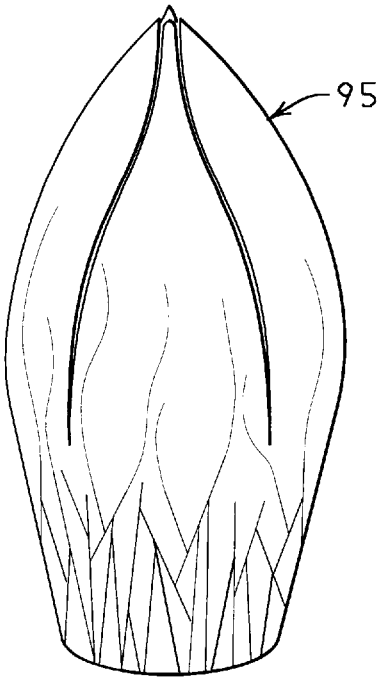
FIG. 21 is a pictorial representation of a breathable package formed about the pot and floral grouping using the decorative cover of FIG. 20.
Figure 22:
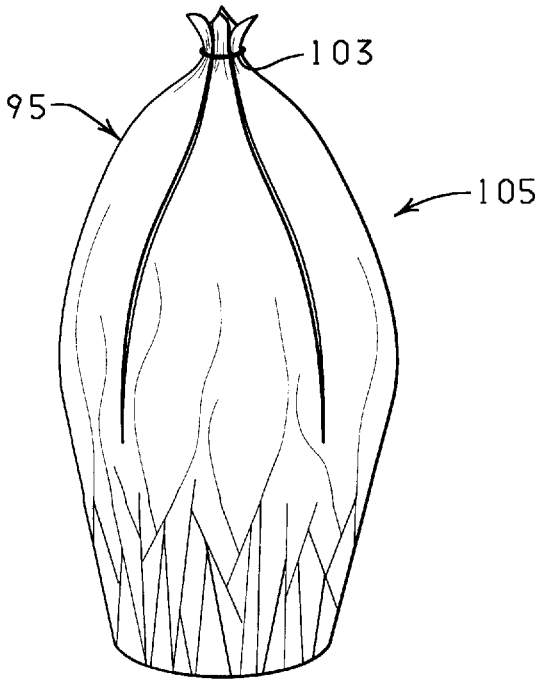
FIG. 22 is a pictorial representation of a breathable package formed about the pot and floral grouping of FIG. 21 wherein a band is positioned about an upper end portion of the breathable package.

As shown in FIGS. 20–22, the preformed decorative cover 95 may be sealed about a potted plant, such as the flower pot 82 and the plant 98 and growing medium 101 contained therein, by gathering the edges of the preformed decorative cover 95 upward and sealing them together via the bonding material 24*e* (FIG. 20) or with a band 103 (FIG. 22), thereby creating a sealed breathable decorative wrapper or package 105. However, it will be understood that the decorative cover 80 may also be sealed about a potted plant in a similar manner.

The term "potted plant" as used herein refers to a plant 98 having a bloom or foliage portion, a stem portion and a root portion, the root portion disposed in the growing medium 101. The term "potted plant" as used herein also includes botanical items and propagules. The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

Description of FIGS. 23–32

Figure 23:
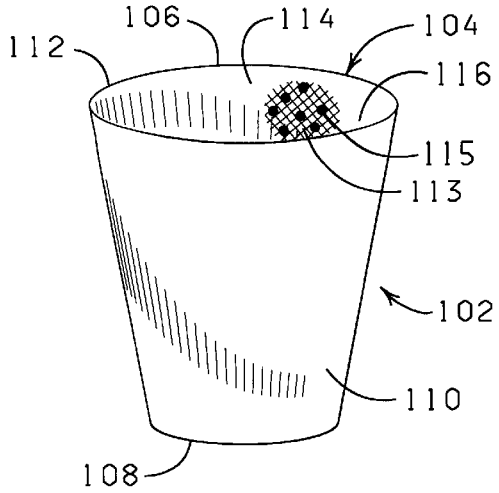
FIG. 23 is a perspective view of a floral sleeve constructed from the breathable packaging material of the present invention.
Figure 24:
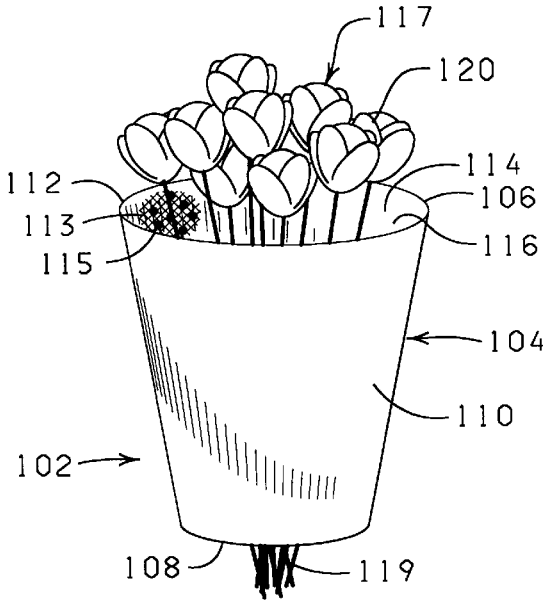
FIG. 24 is a perspective view of the floral sleeve of FIG. 23 showing a floral grouping disposed therein.
Figure 25:
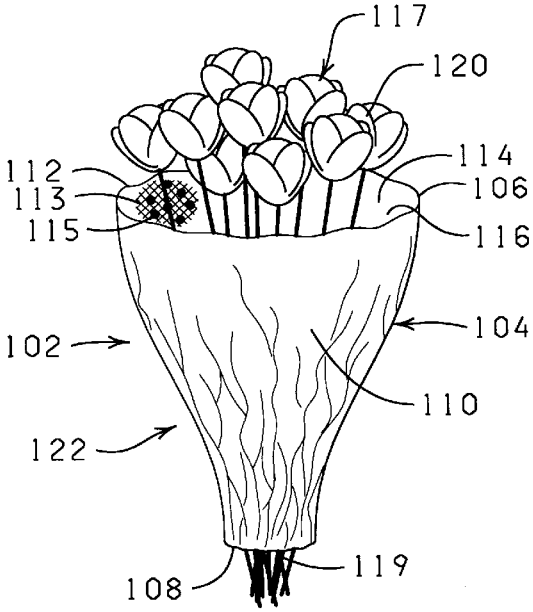
FIG. 25 is a perspective view of the floral sleeve having a floral grouping disposed therein of FIG. 24 wherein a portion of the floral sleeve is crimped about a stem portion of the floral grouping.

Shown in FIGS. 23–25 and designated therein by the general reference numeral 102 is a decorative wrapper for a floral grouping formed of a breathable packaging material constructed in accordance with the present invention. The breathable packaging material is substantially similar in construction to the breathable packaging material 10, shown in FIGS. 1–4 and described in detail herein previously. The decorative wrapper 102 comprises a sleeve 104 which is generally tubular in shape. The sleeve 104 has a first end 106, a second end 108, an outer peripheral surface 110 and an opening 112 intersecting both the first end 106 and the second end 108 so as to form an inner peripheral surface 114 and thereby provide a retaining space 116 therein. The second end 108 may be closed (not shown), whereby the opening 112 only intersects the first end 106 of the sleeve 104, or the second end 108 may remain open, as shown in FIGS. 23–25. Sleeves and their construction are well known in the art, and sleeves are commercially available, as are various devices and mechanisms capable of forming sleeves.

Referring more specifically to FIGS. 24–25, the sleeve 104 is adapted to receive a floral grouping 117 within the retaining space 116. The floral grouping 117 may be disposed in the opening 112 in the sleeve 104 and contained substantially in the retaining space 116 of the sleeve 104, as will be described in detail below.

As shown in FIG. 23, the sleeve 104 is also provided with a lacquer or coating composition 113 disposed on at least a portion of the inner peripheral surface 114 of the sleeve 104, wherein the lacquer or coating composition 113 is substantially similar to the lacquer or coating composition 30 of the breathable packaging material 10 described herein before with reference to FIG. 1. At least one atmosphere control agent 115, substantially similar to the atmosphere control agents 30 described herein before with reference to the breathable packaging material 10 of FIG. 1, is mixed with or incorporated in the lacquer or coating composition 113. Optionally, the sleeve 104 may be free of the lacquer or coating composition 113, and the atmosphere control agent (s) 115 may be incorporated in a bonding material 118 disposed on the sleeve 104, wherein the bonding material 118 will be described in further detail herein below. In addition, the atmosphere control agent(s) 115 may be disposed in the sleeve 104 by incorporation of the atmosphere control agent(s) 115 during formation of the material from which the sleeve 104 is constructed.

The sleeve 104 is generally tubularly-shaped, but the sleeve 104 may be, by way of example but not by way of limitation, cylindrical, conical, frusto-conical, or a combination of both frusto-conical and cylindrical (not shown). Further, as long as the sleeve 104 is capable of receiving the floral grouping 117, any shape of sleeve 104, whether geometric, non-geometric, asymmetrical and/or fanciful, may be utilized.

In a general method of use, illustrated in FIGS. 24–25, at least a portion of the floral grouping 117 is disposed within the sleeve 104. In some applications, a stem portion 119 of the floral grouping 117 extends into the sleeve 104 via the open first end 106, extending through the open second end 108 of the sleeve 104 and beyond the open second end 108. A bloom portion 120 of the floral grouping 117 is therefore disposed adjacent the open first end 106 of the sleeve 104 and the bloom portion 120 of the floral grouping 117 is visible above the first end 106 of the sleeve 104 (FIGS. 24–25). That is, the bloom portion 120 of the floral grouping 117 extends above the open first end 106 of the sleeve 104. In some applications, the second end 108 may be able to be closed if desired; and in some applications, the first end 106 of the sleeve 104 may be able to be closed if desired. When both the first and second ends 106 and 108 of the sleeve 104 are able to be closed, at least one of the first and second ends 106 and 108 remains open until the floral grouping 117 is disposed in the retaining space 116 of the sleeve 104, and following disposal of the floral grouping 117 therein, the end 106 or 108 which remains open may be closed such that the sleeve 104 is sealed about the floral grouping 117 therein, forming a breathable decorative wrapper or package for the floral grouping 117.

In one method of use (FIGS. 24–25), an operator provides a sleeve 104 and a floral grouping 117. The operator then disposes the floral grouping 117 through the opening 112 in the sleeve 104 and into the retaining space 116 thereof by inserting first the stem portion 119 of the floral grouping 117 into the retaining space 116 of the sleeve 104 via the opening 112 in the first end 106, in a manner which permits a portion of the stem portion 119 to be disposed in the retaining space 116 adjacent the second end 108 of the sleeve 104, the second end 108 generally having the narrowest diameter. In inserting the floral grouping 117 into the sleeve 104 in this manner, the bloom portion 120 may be disposed in the retaining space 116 of the sleeve 104 or the bloom portion 120 may be disposed above the sleeve. In this method, at least a portion of the stem portion 119 of the floral grouping 117 extends slightly beyond the second end 108 of the sleeve 104, and the bloom portion 120 of the floral grouping 117 is clearly visible.

The sleeve 104 may then be crimped about the floral grouping 117, as shown in FIG. 25. The crimping operation is conducted by an operator after the floral grouping 117 is disposed in the sleeve 104 by crimping at least a portion of the sleeve 104 about a portion of the stem portion 119 of the floral grouping 117. Such crimping may be conducted manually, by grasping and substantially encompassing with one or more hands the portion of the sleeve 104 adjacent the second end 108 thereof and squeezing that portion of the sleeve 104, thereby pressing and gathering both the sleeve 104 against itself and about a portion of the stem portion 119 of the floral grouping 117. The sleeve 104 may is also be crimped by using both a crimping motion (as described above) and a turning motion to create a twisted crimping, resulting in a sleeve 104 which is both crimped as previously described, and which is twisted about at least a portion of the stem portion 119 of the floral grouping 117, the sleeve 104 adjacent the stem portion 119 being rotated, for example, about a portion of the stem portion 119 between about one-eighth of a turn to about a full turn.

If the sleeve 104 is constructed of a material which is substantially shape-sustaining, the sleeve 104 will retain the crimped position following crimping. Alternatively, a tie or banding element (not shown) may be provided for retaining the sleeve 104 in the crimped position.

When the floral grouping 117 is disposed in the sleeve 104 by any method described herein or known in the art, the sleeve 104 generally surrounds and encompasses a substantial portion of the floral grouping 117. When the sleeve 104 is disposed about the floral grouping 117, the sleeve 104 forms a decorative wrapper 122 which provides breathable packaging for the floral grouping 117 contained therein.

It will be appreciated that the sleeve 104 has sufficient flexibility but also sufficient rigidity to both remain in and sustain its general shape, thereby substantially surrounding and encompassing the floral grouping 117.

Figure 26:
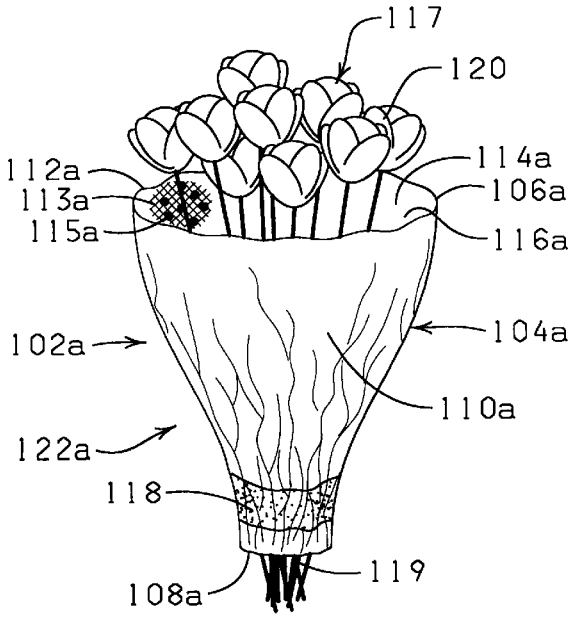
FIG. 26 is a perspective view of a floral sleeve having a floral grouping disposed therein wherein a bonding material is disposed on a portion of an outer surface of the floral sleeve and a portion of the floral sleeve is crimped about a stem portion of the floral grouping.

Shown in FIG. 26 is a wrapper 102*a* formed of a sleeve 104*a* which is substantially similar to the wrapper 102 formed of the sleeve 104 described in detail hereinbefore with reference to FIGS. 23–25, except as described herein below. The sleeve 104*a* is provided with a first end 106*a*, a second end 108*a*, an outer peripheral surface 110*a*, an opening 112*a* therein, an inner peripheral surface 114*a*, and a retaining space 116*a*. The sleeve 104*a* is also provided with a lacquer or coating composition 113*a* disposed on least a portion of one of the surfaces thereof, such as the inner peripheral surface 114*a* as shown in FIG. 26, and the lacquer or coating composition 113*a* contains at least one atmosphere control agent 115*a*, wherein the lacquer or coating composition 113*a* and the atmosphere control agent(s) 115*a* are substantially similar to the lacquer or coating composition 113 and the atmosphere control agent(s) 115 described herein before with reference to the sleeve 104 as illustrated in FIGS. 23–25.

A bonding material 118 is disposed on at least a portion of the outer peripheral surface 110*a* of the sleeve 104*a*, as illustrated in FIG. 26, preferably on the portion of the sleeve 104*a* which will be crimped about the floral to grouping 117 upon disposal of the floral grouping 117 therein. However, it will be understood that the bonding material 118 may be disposed on at least a portion of the inner peripheral surface 114*a* of the sleeve 104*a* (not shown), or, in a further alternative, the bonding material 118 may be disposed on both the inner peripheral surface 114*a* and the outer peripheral surface 110*a* of the sleeve 104*a*.

The bonding material 118 may further be tinted or colored, or a combination of colors, as previously described herein. Further, the bonding material 118 may constitute at least a portion of a design on the sleeve 104*a*. "Designs," as used herein, are defined as any geometric form, or any combination of geometric forms, such as squares, round spots, triangles, rectangles, and octagonals. "Designs" are further defined as any non-geometric, asymmetrical or fanciful forms, or any combination thereof, such as hearts, balloons, flowers, lace, slogans, logos, print (any combination of letters and/or numbers), signs, human forms (real and fictional), animal forms (real and fictional), cartoon characters, and/or plant forms. It will be appreciated that such "designs" may be utilized on any embodiment shown and/or described herein.

Such a design may be a color, or a portion of a color, or any combination of colors. Alternatively, at least a portion of the design may be colorless, translucent, transparent, opaque, pearlescent, iridescent, or the like.

The floral grouping 117 may be disposed in the sleeve 104*a* and the sleeve 104*a* crimped thereabout in a similar manner as that described above for the sleeve 104, as illustrated in FIG. 25. Upon squeezing and/or twisting that portion of the sleeve 104*a* having the bonding material 118 disposed thereon, the bonding material 118 is pressed against itself and portions of the sleeve 104*a* and thereby bondingly connects overlapped portions of the sleeve 104*a* together. In such a manner, the bonding material 118 retains the sleeve 104*a* in a crimped position.

Figure 27:
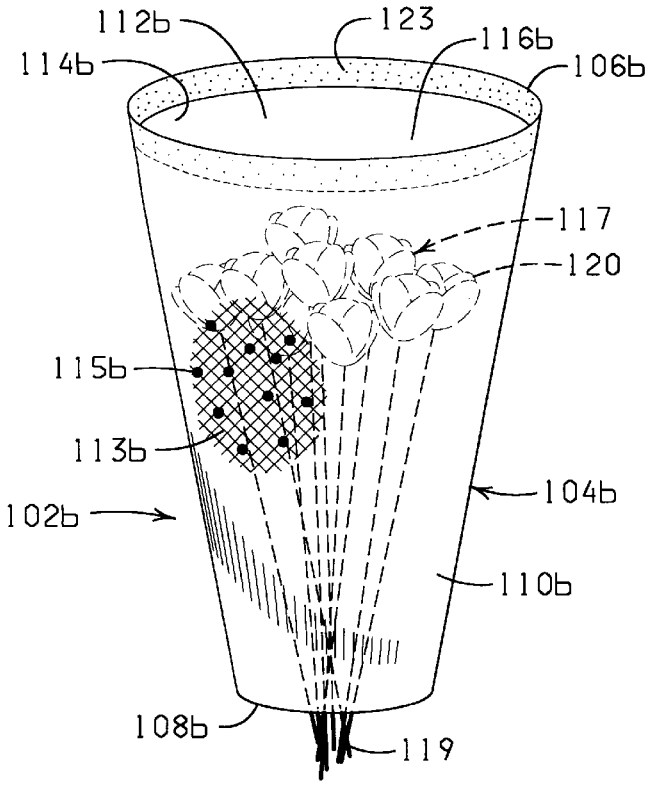
FIG. 27 is a perspective view of a floral sleeve constructed from the breathable packaging material of the present invention, wherein a floral grouping is disposed in the floral sleeve.
Figure 28:
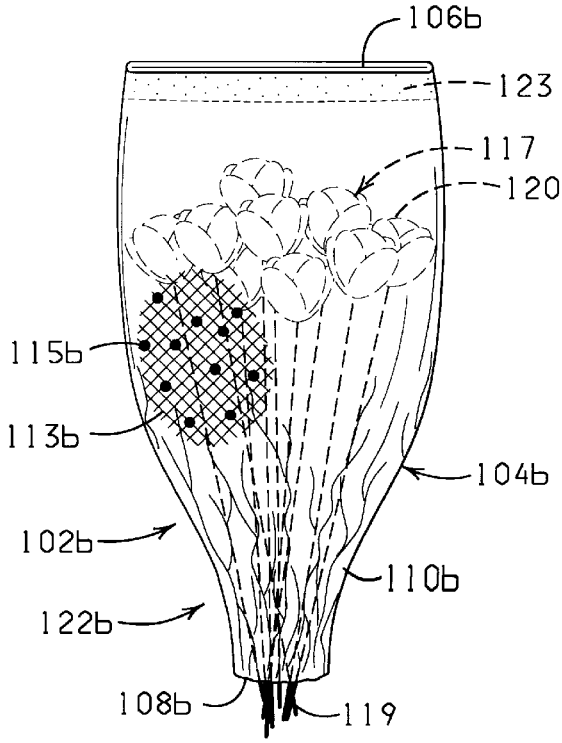
FIG. 28 is a perspective view of the floral sleeve having the floral grouping disposed therein of FIG. 27 wherein an upper end of the floral sleeve is sealed above a bloom portion of the floral grouping.

Shown in FIGS. 27–28 is a modified sleeve 104 which is substantially similar to and used in the same manner as the sleeves 104 and 104*a* described herein before with reference to FIGS. 23–26, except as described hereinbelow. The sleeve 104*b* is provided with a first end 106*b*, a second end 108*b*, an outer peripheral surface 110*b*, an opening 112*b* therein, an inner peripheral surface 114*b*, and a retaining space 116*b*.

The sleeve 104*b* is further provided with a bonding material 123 disposed on at least a portion of the inner peripheral surface 114*b* of the sleeve 104*b* adjacent the first end 106*b* thereof. However, it will be understood that the bonding material 123 may be disposed on at least a portion of the outer peripheral surface 110*b* of the sleeve 104*b* or on at least a portion of both of the outer peripheral surface 110*b* and inner peripheral surface 114*b* thereof.

As shown in FIG. 27, when the floral grouping 117 is disposed in the sleeve 104*b*, the bloom portion 120 of the floral grouping 117 is disposed within the retaining space 116*b* of the sleeve 104*b* such that the first end 106*b* of the sleeve 104*b* extends a distance above the bloom portion 120 of the floral grouping 117. In this manner, the first end 106*b* of the sleeve 104*b* may be sealed via the bonding material 123, thereby sealing the first end 106*b* of the sleeve 104*b* wherein the bloom portion 120 of the floral grouping 117 is sealed within the sleeve 104*b*, substantially as shown in FIG. 28.

Figure 29:
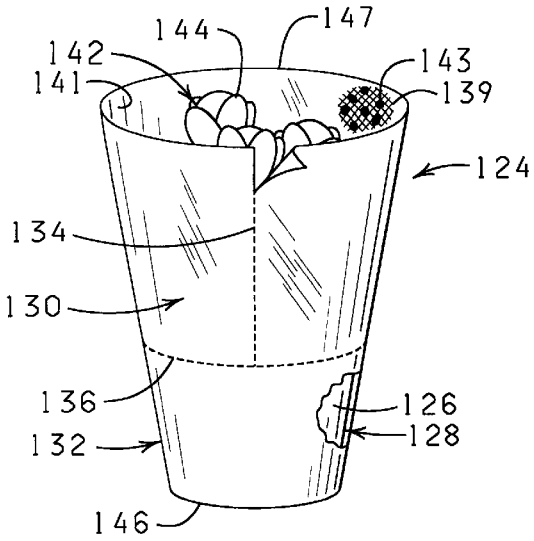
FIG. 29 is a perspective view of a sleeve having a flower pot disposed therein, the sleeve constructed from a breathable packaging material in accordance with the present invention and having vertical and circumferential perforations.
Figure 30:
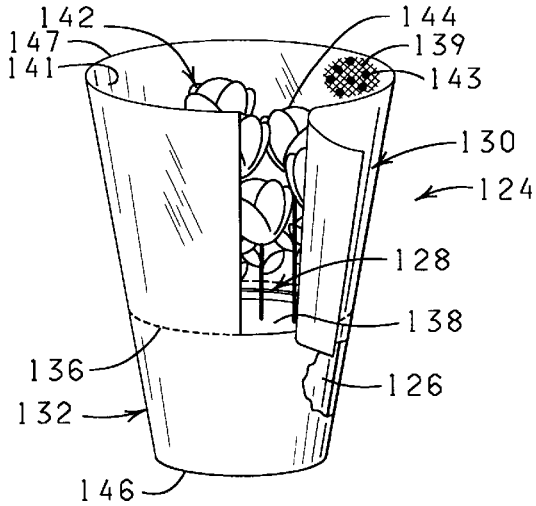
FIG. 30 is a perspective view of the sleeve of FIG. 29 showing the vertical perforation torn open and the circumferential perforations being torn.
Figure 31:
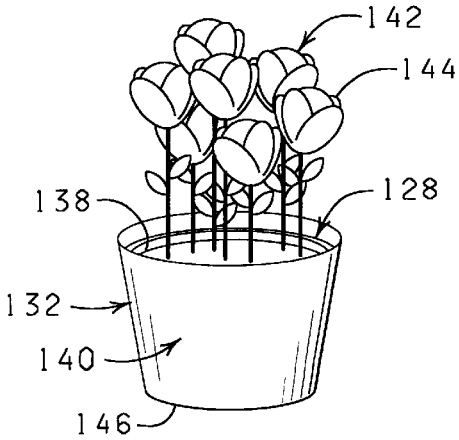
FIG. 31 is a perspective view of the sleeve of FIGS. 29 and 30 showing an upper portion of the sleeve removed, a remaining lower portion of the sleeve forming a decorative cover for the flower pot disposed therein.

Referring now to FIGS. 29–31 and designated by the general reference numeral 124 is a sleeve formed of a breathable packaging material constructed in accordance with the present invention. The breathable packaging material is substantially similar in construction to the breathable packaging material 10 shown in FIGS. 1–4 and described in detail herein previously. The sleeve 124 is disposed about an outer peripheral surface 126 of a flower pot 128. The sleeve 124 is provided with an upper portion 130 and a lower potion 132. The upper portion 130 of the sleeve 124 is removable from the lower portion 132 of the sleeve 124 via vertical perforations 134 and/or circumferential perforations 136 extending about the sleeve 124 near or above the level of an open upper end 138 of the flower pot 128, as illustrated in FIGS. 30 and 31. That is, the upper portion 130 of the sleeve 124 can be removed from the lower portion 132 thereof by tearing the sleeve 124 along the perforations 134 and 136, whereby the lower portion 132 forms a decorative cover 140 for the flower pot 128.

Alternatively, a sleeve similar to the sleeve 102 of FIG. 23 and having an open lower end may be disposed about a flower pot which is already covered by a decorative cover, such as the decorative cover 80 disposed about the flower pot 128 substantially as shown in FIGS. 17 and 18.

In addition, the sleeve 124 may also have a bonding material (not shown) disposed thereupon such that at least a portion of the lower potion 132 of the sleeve 124 can be bondingly connected to the outer peripheral surface 126 of the flower pot 128. Alternatively, a bonding material may be disposed upon the outer peripheral surface 126 of the flower pot 128. In a further alternative, a bonding material may be disposed on at least a portion of the outer peripheral surface 126 of the flower pot 128 and at least a portion of the sleeve 124. As shown in FIGS. 29–31, the flower pot 128 contains a floral grouping 142 having a bloom portion 144.

The sleeve 124 further includes a lacquer or coating composition 139 disposed on at least a portion of an inner peripheral surface 141 thereof, wherein the lacquer or coating composition 139 contains an effective amount of at least one atmosphere control agent 143, wherein the lacquer of coating composition 139 and the atmosphere control agent (s) 143 are substantially similar to the lacquer or coating composition 30 and the atmosphere control agents 32 of the breathable packaging material 10 shown in FIG. 1 and described herein before. Optionally, the sleeve 124 may be free of the lacquer or coating composition 139, and the atmosphere control agent(s) 143 may be disposed in a bonding material disposed on the sleeve 124.

It will be appreciated that the method of disposing the flower pot 128 into the sleeve 124 is generally substantially similar to the method described above for disposing the floral grouping 117 into the sleeve 104.

It will be further understood that the sleeve 124 may be sealed about the flower pot 128 with the floral grouping 142 therein. The sleeve 124 may seal to at least a portion of the outer peripheral surface 126 of the flower pot 128 via a bonding material as previously described; or the sleeve 124 may have a closed lower portion 132, thereby forming a closed bottom 146. In addition, the upper portion 130 of the sleeve 124 may be sealed above the bloom portion 144 of the floral grouping 142 to provide a breathable package in a manner similar to the method of providing the breathable wrapper 105 illustrated in FIGS. 20–22. That is, an upper end 147 of the sleeve 124 may be provided with a bonding material (not shown) disposed thereon, wherein the upper end 147 may be gathered together and bondingly connected via the bonding material to seal and therefore close the upper end 147 of the sleeve 124.

Figure 32:
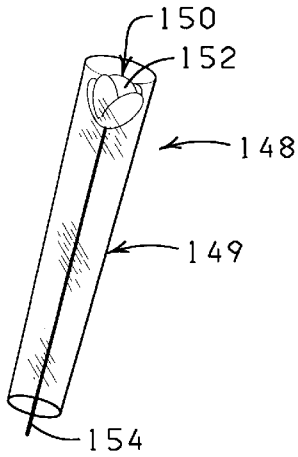
FIG. 32 is a perspective view of a floral sleeve constructed from the breathable packaging material of the present invention, the floral sleeve sized to receive a single flower.

Description of FIG. 32

Shown in FIG. 32 and designated therein by the general reference numeral 148 is a single flower decorative wrapper formed from a breathable packaging material 149 which is substantially similar in construction to the breathable packaging material 10 shown in FIGS. 1–4 and described in detail herein previously. The decorative wrapper 148 is similar to the sleeve 102 hereinbefore described with reference to FIGS. 23–26, except that the decorative wrapper 148 is provided with a narrow tubular shape which is constructed to accommodate a single flower 150 having a bloom portion 152 and a stem portion 154.

It will be appreciated that the breathable packaging material 149 may be formed from a single sheet or layer of material, such as the sheet of material 11 of the breathable packaging material 10 of FIG. 1 as described herein before, or a plurality of sheets or layers of material, as long as the breathable packaging material 149 functions in accordance with the present invention, that is, as long as the breathable packaging material 149 is provided with the controlled atmosphere characteristics described herein for the breathable packaging material 10 and is capable of being formed into the single flower wrapper 148.

Figure 33:
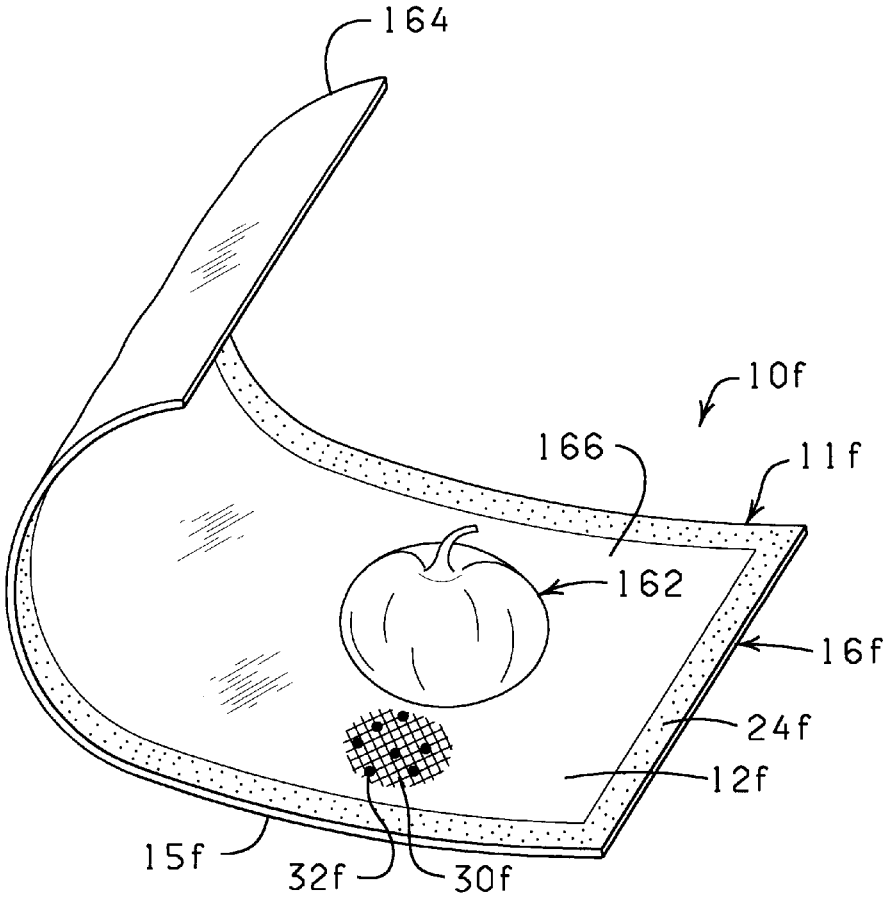
FIG. 33 is a perspective view of a sheet of breathable packaging material constructed in accordance with the present invention, wherein a bonding material is disposed about an outer periphery of the sheet of breathable packaging material, and an apple is disposed on the sheet of breathable packaging material near one side thereof.
Figure 34:
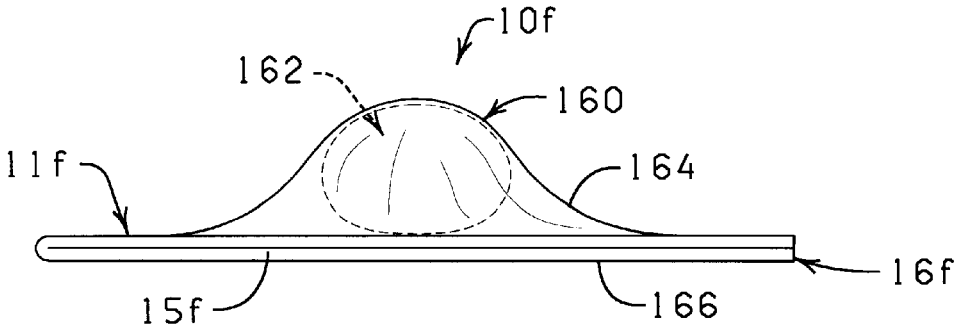
FIG. 34 is a side elevational representation of a packaged apple wherein the apple is encased in the sheet of breathable packaging material of FIG. 33.

Description of FIGS. 33 and 34

Shown in FIGS. 33 and 34 and designated therein by the general reference numeral **10*f* is a breathable packaging material which is formable into a breathable package 160 for fresh produce 162, the breathable packaging material 10*f* being substantially similar in construction to the breathable packaging material 10, shown in FIGS. 1 and 2 and described in detail herein previously, except that a sheet of material 11*f* from which the breathable packaging material 10*f* is formed is desirably transparent, and has a bonding material 24*f* disposed near the outer periphery 15*f* of the sheet of material 11*f*. The breathable packaging material 10*f* is also provided with a lacquer or coating composition 30*f* containing an effective amount of at least one atmosphere control agent 32*f*. However, it will be understood that the sheet of material 11*f* may be free of the lacquer or coating composition 30*f*, and the atmosphere control agent(s) 32*f* may be incorporated in the bonding material 24*f***.

In a method of use, the above-referenced sheet of material **11*f* is provided, as is at least one item of fresh produce 162, in this instance, an apple. "Fresh produce", as used herein, includes fresh vegetables, meat, fruit, dairy products, and the like. "Food" as used herein means any edible item. At least one item of the fresh produce 162 is placed on the upper surface 12*f* of the sheet of material 11*f*, as shown in FIG. 33, the item of fresh produce 162 being disposed near a first side 16*f* of the sheet of material 11*f***.

A portion of the sheet of material **11*f* is shown overlapped over the item of fresh produce 162 (termed a first overlapping portion 164), and the bonding material 24*f* of the first overlapping portion 164 of the sheet of material 11*f* is then aligned with a second overlapping portion 166 of the sheet of material 11*f* upon which the item of fresh produce 162 rests. The bonding material 24*f* of the first overlapping portion 164 is then brought into contact and sealed to the bonding material 24*f* of the second overlapping portion 166 of the sheet of material 11*f* as shown in FIG. 34, thereby sealing the item of fresh produce 162 within the sheet of material 11*f*, forming the breathable package 160**.

It will be appreciated that medical supplies/equipment (not shown) may also be wrapped in a similar manner using a breathable packaging material substantially similar to the breathable packaging material **10*f* described in detail herein before with reference to FIGS. 33 and 34**. It will further be understood that other similar as well as dissimilar methods of wrapping fresh produce and/or medical equipment/supplies are known in the art. "Medical supplies/equipment" as used herein means any disposable or non-disposable item, such as, but not by way of limitation, forceps, sutures, bandages, retractors, and the like.

Further, it will be understood that pharmaceutical products may be wrapped in a similar manner using a breathable packaging material substantially similar to the breathable packaging material **10*f* described in detail herein before with reference to FIGS. 33 and 34**. It will further be understood that other similar as well as dissimilar methods of wrapping pharmaceutical products are known in the art. "Pharmaceutical products" as used herein includes, but is not limited to, capsules, tablets, containers containing pharmaceutical products, and the like.

It will be understood that any embodiment shown and/or described herein, or portion of any embodiment, may be combined with any other embodiment or portion thereof as illustrated and/or described herein. Similarly, it will be appreciated that any method shown and/or described herein, or any step or portion of any method may be combined with any other method or steps thereof shown and/or described herein. To this end, it will be appreciated that all materials and methods for wrapping, forming decorative covers, forming decorative wrappers, and the like shown and/or described herein may comprise or be formed into breathable packages, i.e., packages having controlled atmosphere characteristics.

Changes may be made in the construction and the operation of the various components, elements and assemblies described herein or in the steps or the sequence of steps of the methods described herein without departing from the spirit and scope of the invention as defined in the following claims.

What is claimed:

1. A floral assembly, comprising:

a floral grouping having a bloom portion and a stem portion; and a decorative wrapper formed from a sheet of material having an upper surface, a lower surface and controlled atmosphere characteristics such that the decorative wrapper formed therefrom is permeable to oxygen, carbon dioxide and ethylene and impermeable to water, the sheet of material having a bonding material disposed on at least a portion of one of the upper and lower surfaces thereof, the bonding material containing a desiccant and at least one atmosphere control agent selected from the group consisting of an antifungal agent, an antimicrobial agent and a non-fogging agent, wherein the decorative wrapper surrounds and encompasses the bloom portion of the floral grouping such that an upper end of the decorative wrapper is sealed about the bloom portion of the floral grouping via the bonding material, thereby sealing the bloom portion of the floral grouping in the decorative wrapper whereby the controlled atmosphere characteristics of the sheet of material in combination with the desiccant and at least one atmosphere control agent disposed on the sheet of material provide a controlled atmosphere about the bloom portion of the floral grouping which prevents or retards growth of microorganisms and provides enhanced visual display of the bloom portion of the floral grouping surrounded and encompassed by the decorative wrapper such that the floral grouping is maintained in a commercially viable manner for an increased length of time.

2. The floral assembly of claim 1 wherein the desiccant is selected from the group consisting of calcium chloride and silica gel.

3. The floral assembly of claim 1 wherein the bonding material disposed on at least a portion of the sheet of material contains a desiccant and a non-fogging agent.

4. The floral assembly of claim 1 wherein the bonding material disposed on at least a portion of the sheet of material contains a desiccant and an antimicrobial agent.

5. The floral assembly of claim 1 wherein the bonding material disposed on at least a portion of the sheet of material contains a desiccant, an antimicrobial agent and a non-fogging agent.

6. A floral assembly, comprising:

a floral grouping having a bloom portion and a stem portion; and a decorative wrapper formed from a sheet of material having an upper surface, a lower surface and controlled atmosphere characteristics such that the decorative wrapper formed therefrom is permeable to oxygen, carbon dioxide and ethylene and impermeable to water, the sheet of material having a bonding material and a coating applied to at least a portion of one of the upper and lower surfaces thereof, the coating containing a desiccant and at least one atmosphere control agent selected from the group consisting of an antifungal agent, an antimicrobial agent and a non-fogging agent, wherein the decorative wrapper surrounds and encompasses the bloom portion of the floral grouping such that an upper end of the decorative wrapper is sealed about the bloom portion of the floral grouping via the bonding material, thereby sealing the bloom portion of the floral grouping in the decorative wrapper whereby the controlled atmosphere characteristics of the sheet of material in combination with the desiccant and at least one atmosphere control agent disposed on the sheet of material provide a controlled atmosphere about the bloom portion of the floral grouping which prevents or retards growth of microorganisms and provides enhanced visual display of the bloom portion of the floral grouping surrounded and encompassed by the decorative wrapper such that the floral grouping is maintained in a commercially viable manner for an increased length of time.

7. The floral assembly of claim 6 wherein the coating is a lacquer.

8. The floral assembly of claim 7 wherein the lacquer is a clear acrylic coating composition.

9. The floral assembly of claim 6 wherein the desiccant is selected from the group consisting of calcium chloride and silica gel.

10. The floral assembly of claim 6 wherein the coating disposed on at least a portion of the sheet of material contains a desiccant and a non-fogging agent.

11. The floral assembly of claim 6 wherein the coating disposed on at least a portion of the sheet of material contains a desiccant and an antimicrobial agent.

12. The floral assembly of claim 6 wherein the coating disposed on at least a portion of the sheet of material contains a desiccant, an antimicrobial agent and a non-fogging agent.

13. A breathable package, comprising:

at least one item; and a breathable packaging material comprising a sheet of material having an upper surface, a lower surface and controlled atmosphere characteristics such that the breathable package formed therefrom is permeable to oxygen, carbon dioxide and ethylene and impermeable to water, the sheet of material having a bonding material disposed on at least a portion of one of the upper and lower surfaces thereof, the bonding material containing a desiccant and at least one atmosphere control agent selected from the group consisting of an antifungal agent, an antimicrobial agent and a non-fogging agent; and wherein the breathable packaging material is wrapped and sealed about the at least one item to form the breathable package whereby the controlled atmosphere characteristics of the sheet of material in combination with the desiccant and at least one atmosphere control agent provide a controlled atmosphere about the at least one item which prevents or retards growth of microorganisms and provides enhanced visual display of the at least one item wrapped and sealed in the breathable package such that the at least one item is maintained in a commercially viable manner for an increased length of time.

14. The breathable package of claim 13 wherein the desiccant is selected from the group consisting of calcium chloride and silica gel.

15. The breathable package of claim 13 wherein the bonding material disposed on at least a portion of the sheet of material contains a desiccant and a non-fogging agent.

16. The breathable package of claim 13 wherein the bonding material disposed on at least a portion of the sheet of material contains a desiccant and an antimicrobial agent.

17. The breathable package of claim 13 wherein the bonding material disposed on at least a portion of the sheet of material contains a desiccant, an antimicrobial agent and a non-fogging agent.

18. A breathable package, comprising:

at least one item; and a breathable packaging material comprising a sheet of material having an upper surface, a lower surface and controlled atmosphere characteristics such that the breathable package formed therefrom is permeable to oxygen, carbon dioxide and ethylene and impermeable to water, the sheet of material having a bonding material and a coating disposed on at least a portion of one of the upper and lower surfaces thereof, the coating containing a desiccant and at least one atmosphere control agent selected from the group consisting of an antifungal agent, an antimicrobial agent and a non-fogging agent; and wherein the breathable packaging material is wrapped and sealed about the at least one item via the bonding material to form the breathable package whereby the controlled atmosphere characteristics of the sheet of material in combination with the desiccant and at least one atmosphere control agent provide a controlled atmosphere about the at least one item which prevents or retards growth of microorganisms and provides enhanced visual display of the at least one item wrapped and sealed in the breathable package such that the at least one item is maintained in a commercially viable manner for an increased length of time.

19. The breathable package of claim 18 wherein the coating is a lacquer.

20. The breathable package of claim 19 wherein the lacquer is a clear acrylic coating composition.

21. The breathable package of claim 18 wherein the desiccant is selected from the group consisting of calcium chloride and silica gel.

22. The breathable package of claim 18 wherein the coating disposed on at least a portion of the sheet of material contains a desiccant and a non-fogging agent.

23. The breathable package of claim 18 wherein the coating disposed on at least a portion of the sheet of material contains a desiccant and an antimicrobial agent.

24. The breathable package of claim 18 wherein the coating disposed on at least a portion of the sheet of material contains a desiccant, an antimicrobial agent and a non-fogging agent.

25. A breathable packaging material, comprising:

a sheet of material having an upper surface, a lower surface and controlled atmosphere characteristics such that the sheet of material is permeable to oxygen, carbon dioxide and ethylene and impermeable to water; and a bonding material containing a desiccant and at least one atmosphere control agent selected from the group consisting of an antifungal agent, an antimicrobial agent and a non-fogging agent, the bonding material disposed on at least a portion of at least one of the upper and lower surfaces of the sheet of material whereby upon wrapping the breathable packaging material about an item, the bonding material cooperates with the sheet of material to provide a breathable package for the item.

26. The breathable packaging material of claim 25 wherein the bonding material contains a desiccant and an antimicrobial agent.

27. The breathable packaging material of claim 25 wherein the bonding material contains a desiccant and a non-fogging agent.

28. The breathable packaging material of claim 25 wherein the bonding material contains a desiccant, an antimicrobial agent and a non-fogging agent.

29. The breathable packaging material of claim 25 wherein the desiccant is selected from the group consisting of calcium chloride and silica gel.

30. A breathable packaging material, comprising:

a sheet of material having an upper surface, a lower surface and controlled atmosphere characteristics such that the sheet of material is permeable to oxygen, carbon dioxide and ethylene and impermeable to water;

a bonding material disposed on at least a portion of at least one of the upper and lower surfaces of the sheet of material for securing the breathable packaging material in a wrapped condition about an item; and a coating containing a desiccant and at least one atmosphere control agent selected from the group consisting of an antifungal agent, an antimicrobial agent and a non-fogging agent, the coating disposed on at least a portion of at least one of the upper and lower surfaces of the sheet of material whereby upon wrapping the breathable packaging material about the item, the coating and the sheet of material cooperate to provide a breathable package for the item.

31. The breathable packaging material of claim 30 wherein the desiccant is selected from the group consisting of calcium chloride and silica gel.

32. The breathable packaging material of claim 30 wherein the coating contains a desiccant and an antimicrobial agent.

33. The breathable packaging material of claim 30 wherein the coating contains a desiccant and a non-fogging agent.

34. The breathable packaging material of claim 30 wherein the coating contains a desiccant, an antimicrobial agent and a non-fogging agent.

35. A method for packaging at least one item with a breathable packaging material so as to form a breathable package having a controlled atmosphere about the item, the method comprising the steps of:

providing at least one item;

providing a breathable packaging material formed of a sheet of material having an upper surface, a lower surface and controlled atmosphere characteristics such that the breathable package formed therefrom is permeable to oxygen, carbon dioxide and ethylene and impermeable to water, the sheet of material having a bonding material disposed on at least a portion of at least one of the upper and lower surfaces thereof for securing the sheet of material in a wrapped condition about the at least one item, the bonding material containing a desiccant and at least one atmosphere control agent selected from the group consisting of an antifungal agent, an antimicrobial agent and a non-fogging agent;

wrapping the at least one item in the breathable packaging material; and sealing the breathable packaging material wrapped about the at least one item via the bonding material to form a breathable package containing the at least one item wherein a controlled atmosphere is provided about the at least one item which prevents or retards growth of microorganisms and provides enhanced visual display of the at least one item wrapped and sealed in the breathable package such that the at least one item is maintained in a commercially viable manner for an increased length of time.

36. The method of claim 35 wherein, in the step of providing at least one item, the item is selected from the group consisting of a floral grouping, a flower pot, fresh produce, medical supplies, medical equipment, food and pharmaceutical products.

37. The method of claim 35 wherein, in the step of providing the breathable packaging material, the desiccant is selected from the group consisting of calcium chloride and silica gel.

38. The method of claim 35 wherein, in the step of providing the breathable packaging material, the bonding material contains a desiccant and an antimicrobial agent.

39. The method of claim 35 wherein, in the step of providing the breathable packaging material, the bonding material contains a desiccant and a non-fogging agent.

40. The method of claim 35 wherein, in the step of providing the breathable packaging material, the bonding material contains a desiccant, an antimicrobial agent and a non-fogging agent.

41. A method for packaging at least one item with a breathable packaging material so as to form a breathable package having a controlled atmosphere about the item, the method comprising the steps of:

providing at least one item;

providing a breathable packaging material formed of a sheet of material having an upper surface, a lower surface and controlled atmosphere characteristics such that the breathable package formed therefrom is permeable to oxygen, carbon dioxide and ethylene and impermeable to water, the sheet of material having a coating disposed on at least a portion of at least one of the upper and lower surfaces thereof, the coating containing a desiccant and at least one atmosphere control agent selected from the group consisting of an antifungal agent, an antimicrobial agent and a non-fogging agent, the sheet of material containing a bonding material disposed on at least a portion of at least one of the upper and lower surfaces thereof for securing the sheet of material in a wrapped condition about the at least one item;

wrapping the at least one item in the breathable packaging material; and sealing the breathable packaging material wrapped about the at least one item via the bonding material to form a breathable package containing the at least one item wherein a controlled atmosphere is provided about the at least one item which prevents or retards growth of microorganisms and provides enhanced visual display of the at least one item wrapped and sealed in the breathable package such that the at least one item is maintained in a commercially viable manner for an increased length of time.

42. The method of claim 41 wherein, in the step of providing at least one item, the item is selected from the group consisting of a floral grouping, a flower pot, fresh produce, medical supplies, medical equipment, food and pharmaceutical products.

43. The method of claim 41 wherein, in the step of providing the breathable packaging material, the desiccant is selected from the group consisting of calcium chloride and silica gel.

44. The method of claim 41 wherein, in the step of providing the breathable packaging material, the coating contains a desiccant and an antimicrobial agent.

45. The method of claim 41 wherein, in the step of providing the breathable packaging material, the coating contains a desiccant and a non-fogging agent.

46. The method of claim 41 wherein, in the step of providing the breathable packaging material, the coating contains a desiccant, an antimicrobial agent and a non-fogging agent.

47. A breathable packaging material, comprising:

a sheet of material having an upper surface, a lower surface and controlled atmosphere characteristics such that the sheet of material is permeable to oxygen, carbon dioxide and ethylene and impermeable to water; and a heat sealable lacquer containing a desiccant and at least one atmosphere control agent selected from the group consisting of an antifungal agent, an antimicrobial agent and a non-fogging agent, the heat sealable lacquer disposed on at least a portion of at least one of the upper and lower surfaces of the sheet of material whereby upon wrapping the breathable packaging material about an item, the heat sealable lacquer cooperates with the sheet of material to provide a breathable package for the item.

48. The breathable packaging material of claim 47 wherein the heat sealable lacquer contains a desiccant and an antimicrobial agent.

49. The breathable packaging material of claim 47 wherein the heat sealable lacquer contains a desiccant and a non-fogging agent.

50. The breathable packaging material of claim 47 wherein the heat sealable lacquer contains a desiccant, an antimicrobial agent and a non-fogging agent.

51. The breathable packaging material of claim 47 wherein the desiccant is selected from the group consisting of calcium chloride and silica gel.

52. A floral assembly, comprising:

a floral grouping having a bloom portion and a stem portion; and a decorative wrapper formed from a sheet of material having an upper surface, a lower surface and controlled atmosphere characteristics such that the decorative wrapper formed therefrom is permeable to oxygen, carbon dioxide and ethylene and impermeable to water, the sheet of material having a heat sealable lacquer disposed on at least a portion of one of the upper and lower surfaces thereof, the heat sealable lacquer containing a desiccant and at least one atmosphere control agent selected from the group consisting of an antifungal agent, an antimicrobial agent and a non-fogging agent, wherein the decorative wrapper surrounds and encompasses the bloom portion of the floral grouping such that an upper end of the decorative wrapper is sealed about the bloom portion of the floral grouping via the heat sealable lacquer, thereby sealing the bloom portion of the floral grouping in the decorative wrapper whereby the controlled atmosphere characteristics of the sheet of material in combination with the desiccant and at least one atmosphere control agent disposed on the sheet of material provide a controlled atmosphere about the bloom portion of the floral grouping which prevents or retards growth of microorganisms and provides enhanced visual display of the bloom portion of the floral grouping surrounded and encompassed by the decorative wrapper such that the floral grouping is maintained in a commercially viable manner for an increased length of time.

53. The floral assembly of claim 52 wherein the desiccant is selected from the group consisting of calcium chloride and silica gel.

54. The floral assembly of claim 52 wherein the heat sealable lacquer disposed on at least a portion of the sheet of material contains a desiccant and a non-fogging agent.

55. The floral assembly of claim 52 wherein the heat sealable lacquer disposed on at least a portion of the sheet of material contains a desiccant and an antimicrobial agent.

56. The floral assembly of claim 52 wherein the heat sealable lacquer disposed on at least a portion of the sheet of material contains a desiccant, an antimicrobial agent and a non-fogging agent.

57. A breathable package, comprising:

at least one item; and a breathable packaging material comprising a sheet of material having an upper surface, a lower surface and controlled atmosphere characteristics such that the breathable package formed therefrom is permeable to oxygen, carbon dioxide and ethylene and impermeable to water, the sheet of material having a heat sealable lacquer disposed on at least a portion of one of the upper and lower surfaces thereof, the heat sealable lacquer containing a desiccant and at least one atmosphere control agent selected from the group consisting of an antifungal agent, an antimicrobial agent and a non-fogging agent; and wherein the breathable packaging material is wrapped and sealed about the at least one item via the heat sealable lacquer to form the breathable package whereby the controlled atmosphere characteristics of the sheet of material in combination with the desiccant and at least one atmosphere control agent disposed on the sheet of material provide a controlled atmosphere about the at least one item which prevents or retards growth of microorganisms and provides enhanced visual display of the at least one item wrapped and sealed in the breathable package such that the at least one item is maintained in a commercially viable manner for an increased length of time.

58. The breathable package of claim 57 wherein the desiccant is selected from the group consisting of calcium chloride and silica gel.

59. The breathable package of claim 57 wherein the heat sealable lacquer disposed on at least a portion of the sheet of material contains a desiccant and a non-fogging agent.

60. The breathable package of claim 57 wherein the heat sealable lacquer disposed on at least a portion of the sheet of material contains a desiccant and an antimicrobial agent.

61. The breathable package of claim 57 wherein the heat sealable lacquer disposed on at least a portion of the sheet of material contains a desiccant, an antimicrobial agent and a non-fogging agent.

62. A method for packaging at least one item with a breathable packaging material so as to form a breathable package having a controlled atmosphere about the item, the method comprising the steps of:

providing at least one item;

providing a breathable packaging material formed of a sheet of material having an upper surface, a lower surface and controlled atmosphere characteristics such that the breathable package formed therefrom is permeable to oxygen, carbon dioxide and ethylene and impermeable to water, the sheet of material having a heat sealable lacquer disposed on at least a portion of at least one of the upper and lower surfaces thereof for securing the sheet of material in a wrapped condition about the at least one item, the heat sealable lacquer containing a desiccant and at least one atmosphere control agent selected from the group consisting of an antifungal agent, an antimicrobial agent and a non-fogging agent;

wrapping the at least one item in the breathable packaging material; and sealing the breathable packaging material wrapped about the at least one item via the heat sealable lacquer to form a breathable package containing the at least one item wherein a controlled atmosphere is provided about the at least one item which prevents or retards growth of microorganisms and provides enhanced visual display of the at least one item wrapped and sealed in the breathable package such that the at least one item is maintained in a commercially viable manner for an increased length of time.

63. The method of claim 62 wherein, in the step of providing at least one item, the item is selected from the group consisting of a floral grouping, a flower pot, fresh produce, medical supplies, medical equipment, food and pharmaceutical products.

64. The method of claim 62 wherein, in the step of providing the breathable packaging material, the desiccant is selected from the group consisting of calcium chloride and silica gel.

65. The method of claim 62 wherein, in the step of providing the breathable packaging material, the heat sealable lacquer contains a desiccant and an antimicrobial agent.

66. The method of claim 62 wherein, in the step of providing the breathable packaging material, the heat sealable lacquer contains a desiccant and a non-fogging agent.

67. The method of claim 62 wherein, in the step of providing the breathable packaging material, the heat sealable lacquer contains a desiccant, an antimicrobial agent and a non-fogging agent.

68. A breathable packaging material, comprising:

a sheet of material having an upper surface, a lower surface and controlled atmosphere characteristics such that the sheet of material is permeable to oxygen, carbon dioxide and ethylene and impermeable to water, the sheet of material having a desiccant and at least one atmosphere control agent selected from the group consisting of an antifungal agent, an antimicrobial agent and a non-fogging agent incorporated therein; and a bonding material disposed on at least a portion of at least one of the upper and lower surfaces of the sheet of material for sealing the breathable packaging material about an item.

69. The breathable packaging material of claim 68 wherein the sheet of material contains a desiccant and an antimicrobial agent incorporated therein.

70. The breathable packaging material of claim 68 wherein the sheet of material contains a desiccant and a non-fogging agent incorporated therein.

71. The breathable packaging material of claim 68 wherein the sheet of material contains a desiccant, an antimicrobial agent and a non-fogging agent incorporated therein.

72. The breathable packaging material of claim 68 wherein the desiccant is selected from the group consisting of calcium chloride and silica gel.

73. A floral assembly, comprising:

a floral grouping having a bloom portion and a stem portion; and a decorative wrapper formed from a sheet of material having an upper surface, a lower surface and controlled atmosphere characteristics such that the decorative wrapper formed therefrom is permeable to oxygen, carbon dioxide and ethylene and impermeable to water, the sheet of material having a desiccant and at least one atmosphere control agent selected from the group consisting of an antifungal agent, an antimicrobial agent and a non-fogging agent incorporated therein, the sheet of material provided with a bonding material disposed on at least a portion of at least one of the upper and lower surfaces thereof, wherein the decorative wrapper surrounds and encompasses the bloom portion of the floral grouping such that an upper end of the decorative wrapper is sealed about the bloom portion of the floral grouping via the bonding material, thereby sealing the bloom portion of the floral grouping in the decorative wrapper whereby the controlled atmosphere characteristics of the sheet of material in combination with the desiccant and at least one atmosphere control agent disposed on the sheet of material provide a controlled atmosphere about the bloom portion of the floral grouping which prevents or retards growth of microorganisms and provides enhanced visual display of the bloom portion of the floral grouping surrounded and encompassed by the decorative wrapper such that the floral grouping is maintained in a commercially viable manner for an increased length of time.

74. The floral assembly of claim 73 wherein the desiccant is selected from the group consisting of calcium chloride and silica gel.

75. The floral assembly of claim 73 wherein the sheet of material contains a desiccant and a non-fogging agent incorporated therein.

76. The floral assembly of claim 73 wherein the sheet of material contains a desiccant and an antimicrobial agent incorporated therein.

77. The floral assembly of claim 73 wherein the sheet of material contains a desiccant, an antimicrobial agent and a non-fogging agent incorporated therein.

78. A breathable package, comprising:

at least one item; and a breathable packaging material comprising a sheet of material having an upper surface, a lower surface and controlled atmosphere characteristics such that the breathable package formed therefrom is permeable to oxygen, carbon dioxide and ethylene and impermeable to water, the sheet of material containing a desiccant and at least one atmosphere control agent selected from the group consisting of an antifungal agent, an antimicrobial agent and a non-fogging agent incorporated therein, the sheet of material provided with a bonding material disposed on at least a portion of at least one of the upper and lower surfaces thereof, wherein the breathable packaging material is wrapped and sealed about the at least one item such that the controlled atmosphere characteristics of the sheet of material in combination with the desiccant and at least one atmosphere control agent provide a controlled atmosphere about the at least one item which prevents or retards growth of microorganisms and provides enhanced visual display of the at least one item wrapped and sealed in the breathable package such that the at least one item is maintained in a commercially viable manner for an increased length of time.

79. The breathable package of claim 78 wherein the desiccant is selected from the group consisting of calcium chloride and silica gel.

80. The breathable package of claim 78 wherein the sheet of material contains a desiccant and a non-fogging agent incorporated therein.

81. The breathable package of claim 78 wherein the sheet of material contains a desiccant and an antimicrobial agent incorporated therein.

82. The breathable package of claim 78 wherein the sheet of material contains a desiccant, an antimicrobial agent and a non-fogging agent incorporated therein.

83. A method for packaging at least one item with a breathable packaging material so as to form a breathable package having a controlled atmosphere about the item, the method comprising the steps of:

providing at least one item;

providing a breathable packaging material formed of a sheet of material having an upper surface, a lower surface and controlled atmosphere characteristics such that the breathable package formed therefrom is permeable to oxygen, carbon dioxide and ethylene and impermeable to water, the sheet of material containing a desiccant and at least one atmosphere control agent selected from the group consisting of an antifungal agent, an antimicrobial agent and a non-fogging agent incorporated therein, the sheet of material having a bonding material disposed on at least a portion of at least one of the upper and lower surfaces thereof for securing the sheet of material in a wrapped condition about the at least one item;

wrapping the at least one item in the breathable packaging material; and sealing the breathable packaging material wrapped about the at least one item via the bonding material to form a breathable package containing the at least one item wherein a controlled atmosphere is provided about the at least one item which prevents or retards growth of microorganisms and provides enhanced visual display of the at least one item wrapped and sealed in the breathable package such that the at least one item is maintained in a commercially viable manner for an increased length of time.

84. The method of claim 83 wherein, in the step of providing at least one item, the item is selected from the group consisting of a floral grouping, a flower pot, fresh produce, medical supplies, medical equipment, food and pharmaceutical products.

85. The method of claim 83 wherein, in the step of providing the breathable packaging material, the desiccant is selected from the group consisting of calcium chloride and silica gel.

86. The method of claim 83 wherein, in the step of providing the breathable packaging material, the sheet of material contains a desiccant and an antimicrobial agent incorporated therein.

87. The method of claim 83 wherein, in the step of providing the breathable packaging material, the sheet of material contains a desiccant and a non-fogging agent incorporated therein.

88. The method of claim 83 wherein, in the step of providing the breathable packaging material, the sheet of material contains a desiccant, an antimicrobial agent and a non-fogging agent incorporated therein.

89. A breathable package, comprising:

at least one item; and a breathable packaging material comprising a sheet of material having an upper surface, a lower surface and controlled atmosphere characteristics such that the breathable package formed therefrom is permeable to oxygen, carbon dioxide and ethylene and impermeable to water, the sheet of material having a coating disposed on at least a portion of one of the upper and lower surfaces thereof, the coating containing a desiccant and at least one atmosphere control agent selected from the group consisting of an antifungal agent, an antimicrobial agent and a non-fogging agent; and wherein the breathable packaging material is wrapped and sealed about the at least one item to form the breathable package whereby the controlled atmosphere characteristics of the sheet of material in combination with the desiccant and at least one atmosphere control agent provide a controlled atmosphere about the at least one item which prevents or retards growth of microorganisms and provides enhanced visual display of the at least one item wrapped and sealed in the breathable package such that the at least one item is maintained in a commercially viable manner for an increased length of time.

90. The breathable package of claim 89 wherein the coating is a lacquer.

91. The breathable package of claim 90 wherein the lacquer is a clear acrylic coating composition.

92. The breathable package of claim 89 wherein the desiccant is selected from the group consisting of calcium chloride and silica gel.

93. A floral assembly, comprising:

a floral grouping having a bloom portion and a stem portion; and a decorative wrapper formed from a sheet of material having an upper surface, a lower surface and controlled atmosphere characteristics such that the decorative wrapper formed therefrom is permeable to oxygen, carbon dioxide and ethylene and impermeable to water, the sheet of material having a coating applied to at least a portion of one of the upper and lower surfaces thereof, the coating containing a desiccant and at least one atmosphere control agent selected from the group consisting of an antifungal agent, an antimicrobial agent and a non-fogging agent, wherein the decorative wrapper surrounds and encompasses the bloom portion of the floral grouping such that an upper end of the decorative wrapper is sealed about the bloom portion of the floral grouping, thereby sealing the bloom portion of the floral grouping in the decorative wrapper whereby the controlled atmosphere characteristics of the sheet of material in combination with the desiccant and at least one atmosphere control agent disposed on the sheet of material provide a controlled atmosphere about the bloom portion of the floral grouping which prevents or retards growth of microorganisms and provides enhanced visual display of the bloom portion of the floral grouping surrounded and encompassed by the decorative wrapper such that the floral grouping is maintained in a commercially viable manner for an increased length of time.

94. The floral assembly of claim 93 wherein the coating is a lacquer.

95. The floral assembly of claim 94 wherein the lacquer is a clear acrylic coating composition.

96. The floral assembly of claim 93 wherein the desiccant is selected from the group consisting of calcium chloride and silica gel.

97. A method for packaging at least one item with a breathable packaging material so as to form a breathable package having a controlled atmosphere about the item, the method comprising the steps of:

providing at least one item;

providing a breathable packaging material formed of a sheet of material having an upper surface, a lower surface and controlled atmosphere characteristics such that the breathable package formed therefrom is permeable to oxygen, carbon dioxide and ethylene and impermeable to water, the sheet of material having a coating disposed on at least a portion of at least one of the upper and lower surfaces thereof, the coating containing a desiccant and at least one atmosphere control agent selected from the group consisting of an antifungal agent, an antimicrobial agent and a non-fogging agent;

wrapping the at least one item in the breathable packaging material; and sealing the breathable packaging material wrapped about the at least one item to form a breathable package containing the at least one item wherein a controlled atmosphere is provided about the at least one item which prevents or retards growth of microorganisms and provides enhanced visual display of the at least one item wrapped and sealed in the breathable package such that the at least one item is maintained in a commercially viable manner for an increased length of time.

98. The method of claim 97 wherein, in the step of providing a breathable packaging material, the coating is a lacquer.

99. The method of claim 98 wherein the lacquer is a clear acrylic coating composition.

100. The method of claim 97 wherein, in the step of providing a breathable packaging material, the desiccant is selected from the group consisting of calcium chloride and silica gel.

101. A method for providing a breathable packaging for a floral grouping, comprising the steps of:

providing a floral grouping having a bloom portion and a stem portion;

providing a breathable packaging material formed of a sheet of material having an upper surface, a lower surface and controlled atmosphere characteristics such that a decorative wrapper formed therefrom is permeable to oxygen, carbon dioxide and ethylene and impermeable to water, the sheet of material having a coating applied to at least a portion of one of the upper and lower surfaces thereof, the coating containing a desiccant and at least one atmosphere control agent selected from the group consisting of an antifungal agent, an antimicrobial agent and a non-fogging agent;

disposing the floral grouping on the upper surface of the sheet of material from which the breathable packaging material is formed; and wrapping the breathable packaging material about the floral grouping to provide the decorative wrapper which surrounds and encompasses the bloom portion of the floral grouping such that an upper end of the decorative wrapper is sealed about the bloom portion of the floral grouping, thereby sealing the bloom portion of the floral grouping in the decorative wrapper whereby the controlled atmosphere characteristics of the sheet of material in combination with the desiccant and at least one atmosphere control agent disposed on the sheet of material provide a controlled atmosphere about the bloom portion of the floral grouping which prevents or retards growth of microorganisms and provides enhanced visual display of the bloom portion of the floral grouping surrounded and encompassed by the decorative wrapper such that the floral grouping is maintained in a commercially viable manner for an increased length of time.

102. The method of claim 101 wherein, in the step of providing a breathable packaging material, the coating is a lacquer.

103. The method of claim 102 wherein the lacquer is a clear acrylic coating composition.

104. The method of claim 101 wherein, in the step of providing a breathable packaging material, the desiccant is selected from the group consisting of calcium chloride and silica gel.

* * * * *